US007647790B2

(12) United States Patent
Ignatiev et al.

(10) Patent No.: US 7,647,790 B2
(45) Date of Patent: Jan. 19, 2010

(54) INJECTION SYSTEM AND METHOD FOR REFRIGERATION SYSTEM COMPRESSOR

(75) Inventors: Kirill Ignatiev, Sidney, OH (US); Jean-Luc M Caillat, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 134 days.

(21) Appl. No.: 11/707,628

(22) Filed: Feb. 19, 2007

(65) Prior Publication Data

US 2008/0078192 A1 Apr. 3, 2008

Related U.S. Application Data

(63) Continuation-in-part of application No. 11/541,951, filed on Oct. 2, 2006.

(60) Provisional application No. 60/880,698, filed on Jan. 16, 2007.

(51) Int. Cl.
*F25B 43/00* (2006.01)
*F25B 41/00* (2006.01)
*F25B 43/02* (2006.01)

(52) U.S. Cl. ..... 62/512; 62/473; 62/513

(58) Field of Classification Search ..... 62/470, 62/473, 501, 502, 512, 513; 417/251, 252, 417/313

See application file for complete search history.

(56) References Cited

U.S. PATENT DOCUMENTS 2,697,334 A 12/1954 Clarke
2,820,350 A 1/1958 Sheets
3,738,780 A 6/1973 Edstrom
3,795,117 A 3/1974 Moody, Jr. et al.
3,811,291 A * 5/1974 Schibbye ..... 62/84
3,885,402 A 5/1975 Moody, Jr. et al.

(Continued)

FOREIGN PATENT DOCUMENTS

EP 1 492 986 B1 11/2007

(Continued)

OTHER PUBLICATIONS

Marks' Standard Handbook for Mechanical Engineers, Eugene A. Avallone and Theodore Baumeister, 10th edition, 1996, McGraw-Hill, pp. 19.1 and 19.5.*

(Continued)

*Primary Examiner*—Frantz F. Jules
*Assistant Examiner*—Cassey Bauer
(74) *Attorney, Agent, or Firm*—Harness, Dickey & Pierce, P.L.C.

(57) ABSTRACT

A refrigeration system can incorporate a cooling-liquid injection system that can inject a cooling liquid into an intermediate-pressure location of the compressor. The cooling liquid can absorb the heat of compression during the compression of the refrigerant flowing therethrough. The refrigeration system can include an economizer system that injects a refrigerant vapor into an intermediate-pressure location of the compressor in conjunction with the injection of the cooling liquid. A refrigeration system can include a liquid-refrigerant injection system that can inject liquid refrigerant into an intermediate-pressure location of the compressor. The injected liquid refrigerant can reduce the discharge temperature of the refrigerant. The liquid-refrigerant injection system can be used with the cooling-liquid injection system and/or the economizer system.

49 Claims, 11 Drawing Sheets

U.S. PATENT DOCUMENTS 3,913,346 A 10/1975 Moody, Jr. et al.
3,996,745 A 12/1976 Davoud et al.
4,005,949 A 2/1977 Grant
4,062,199 A 12/1977 Kasahara et al.
4,196,594 A 4/1980 Abom
4,316,366 A 2/1982 Manning
4,419,865 A * 12/1983 Szymaszek ..... 62/193
4,509,341 A 4/1985 Zimmern
4,545,742 A 10/1985 Schaefer
4,702,086 A 10/1987 Nunn, Sr. et al.
4,727,725 A 3/1988 Nagata et al.
4,861,246 A 8/1989 Zimmern
4,877,382 A 10/1989 Caillat et al.
4,899,555 A 2/1990 Shaw
4,903,497 A 2/1990 Zimmern et al.
4,947,655 A 8/1990 Shaw
4,959,972 A 10/1990 Lowes
4,974,427 A 12/1990 Diab
5,079,930 A 1/1992 Beaverson et al.
5,095,712 A 3/1992 Narreau
5,447,420 A 9/1995 Caillat et al.
5,457,966 A 10/1995 Nivens
5,475,985 A 12/1995 Heinrichs et al.
5,582,022 A 12/1996 Heinrichs et al.
5,996,364 A 12/1999 Lifson et al.
6,021,645 A 2/2000 Hara
6,032,472 A 3/2000 Heinrichs et al.
6,058,727 A * 5/2000 Fraser et al. ..... 62/190
6,105,378 A 8/2000 Shaw
6,167,722 B1 1/2001 Kasezawa et al.
6,231,324 B1 5/2001 Clendenin et al.
6,257,840 B1 7/2001 Ignatiev et al.
6,350,111 B1 2/2002 Perevozchikov et al.
6,374,631 B1 4/2002 Lifson et al.
6,385,981 B1 5/2002 Vaisman
6,428,296 B1 8/2002 Elson et al.
6,571,576 B1 6/2003 Lifson et al.
6,581,397 B1 6/2003 Taira et al.
6,694,750 B1 2/2004 Lifson et al.
6,945,073 B2 9/2005 Matsumoto et al.
7,013,664 B2 3/2006 Matsumoto
7,076,968 B2 7/2006 Matsumoto
7,101,162 B2 * 9/2006 Matsumoto et al. ..... 418/60
7,204,099 B2 4/2007 Lifson et al.
2002/0187064 A1 * 12/2002 Vigano et al. ..... 418/201.3
2005/0044885 A1 * 3/2005 Pearson ..... 62/512
2005/0089432 A1 4/2005 Truyens et al.
2005/0172661 A1 * 8/2005 Matsumoto et al. ..... 62/470

FOREIGN PATENT DOCUMENTS

KR 10-0153441 1/1999

OTHER PUBLICATIONS

Comressor Handbook, Paul C. Hanlon, 2001, McGraw-Hill,pp. 2.3-2.4 and 12.2-12.4.*
International Search Report regarding International Application No. PCT/US2007/021129.
Written Opinion of the International Searching Authority regarding International Application No. PCT/US2007/021129.

* cited by examiner

FIG 5
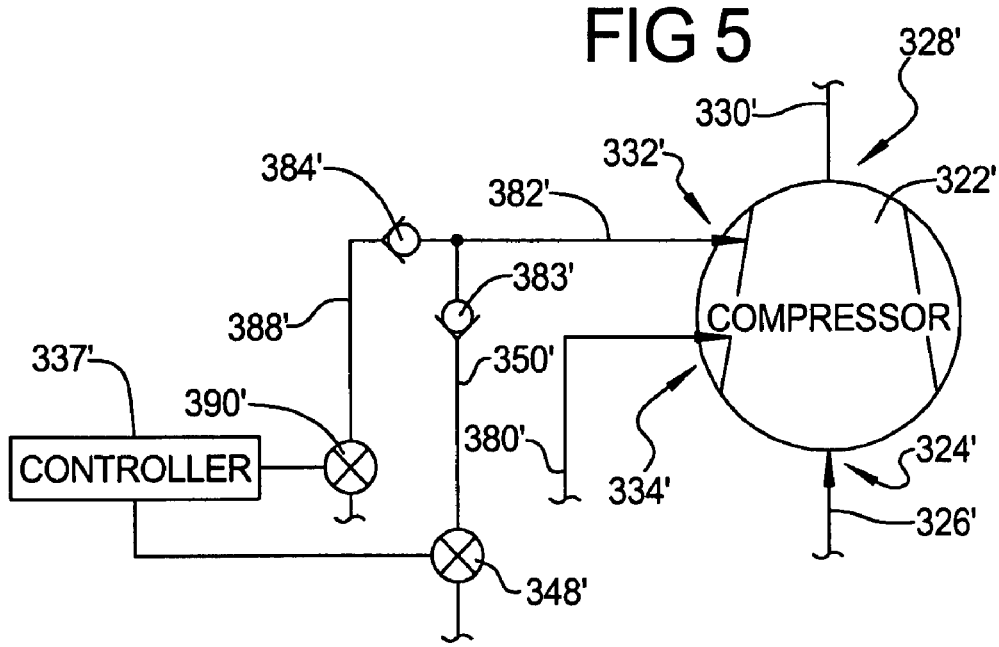
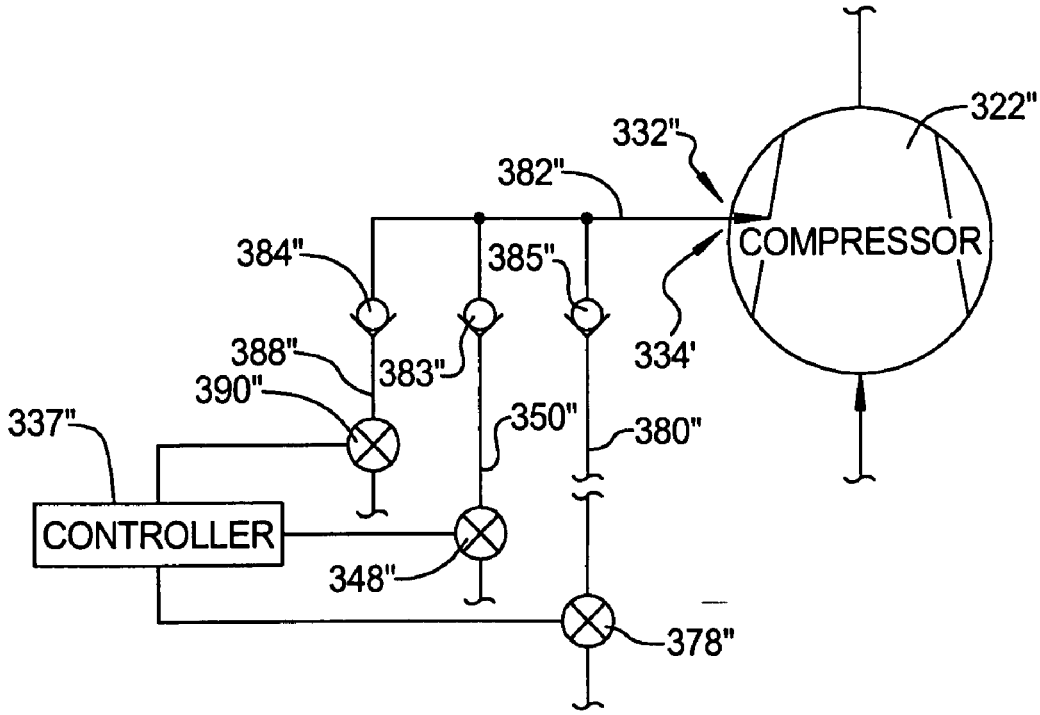
FIG 6

FIG 12
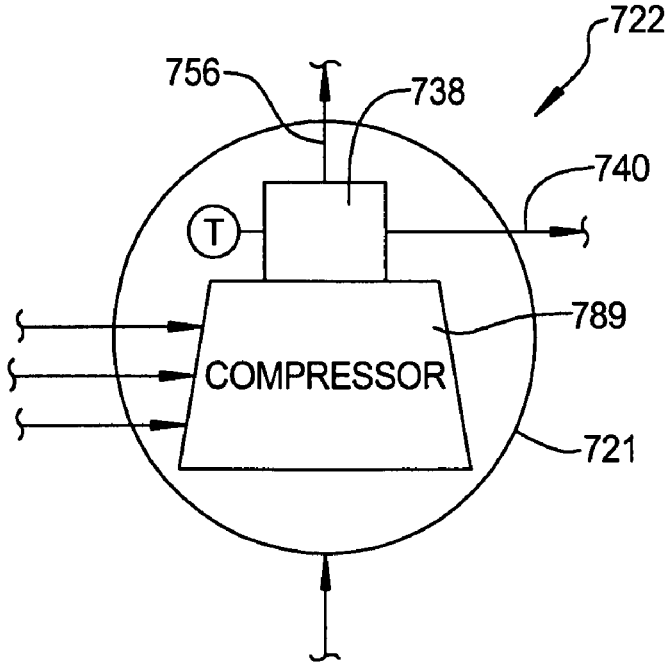
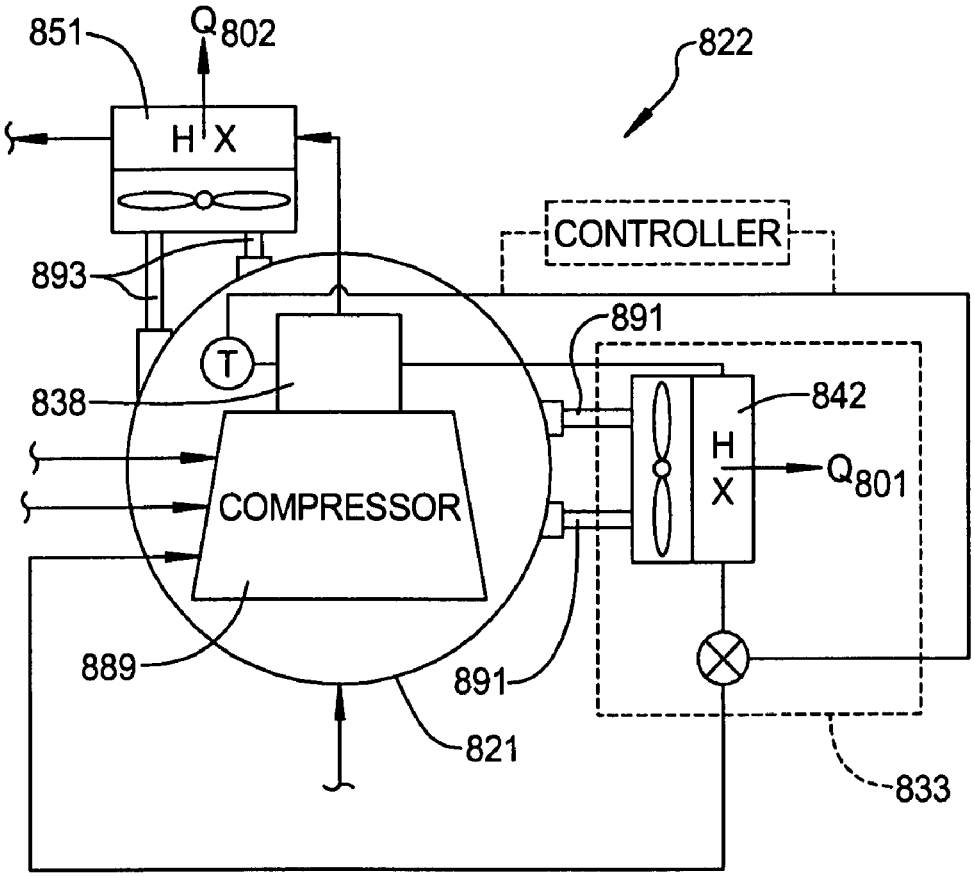
FIG 13

INJECTION SYSTEM AND METHOD FOR REFRIGERATION SYSTEM COMPRESSOR

CROSS-REFERENCE TO RELATED APPLICATIONS

This application is a continuation-in-part of U.S. patent application Ser. No. 11/541,951 filed on Oct. 2, 2006. This application claims the benefit of U.S. Provisional Application No. 60/880,698, filed on Jan. 16, 2007. The disclosures of the above applications are incorporated herein by reference.

FIELD

The present teachings relate generally to refrigeration and, more particularly, to injection systems and methods for refrigeration compressors.

BACKGROUND AND SUMMARY

The statements in this section merely provide background information related to the present teachings and may not constitute prior art.

Compressors are utilized to compress refrigerant for refrigeration systems, such as air conditioning, refrigeration, etc. During the compression of the refrigerant within the compressor, a significant quantity of heat can be generated, which may result in the temperature of the discharged refrigerant being relatively high. A reduction in the discharge temperature of the refrigerant can increase the cooling capacity and efficiency of the refrigeration system.

A refrigeration system according to the present teachings may incorporate a liquid-refrigerant injection system that can provide liquid refrigerant to an intermediate-pressure location of the compressor and absorb heat during compression of the refrigerant flowing therethrough. The injected liquid refrigerant may decrease the temperature of the compression process and the temperature of the refrigerant discharged from the compressor.

A refrigeration system according to the present teachings may also include a single-phase cooling-liquid injection system that provides a single-phase cooling liquid to an intermediate-pressure location of the compressor and absorbs heat during the compression of the refrigerant flowing therethrough. The cooling liquid, which may be externally separated from the refrigerant flow, may decrease the temperature of the refrigerant being discharged by the compressor, resulting in an increased cooling capacity and/or an increased efficiency. Use of the cooling-liquid injection system in conjunction with the liquid-refrigerant injection system may further increase cooling capacity and/or increase efficiency of the compressor.

A refrigeration system according to the present teachings may also include an economizer system that provides a vapor refrigerant to an intermediate-pressure location of the compressor and may reduce the operational temperature of refrigerant prior to flowing through an evaporator, thereby increasing the cooling capacity. Use of the economizer system in conjunction with the liquid-refrigerant injection system and/or the cooling-liquid injection system may further increase the cooling capacity, efficiency, and/or performance of the compressor.

Further areas of applicability will become apparent from the description provided herein. It should be understood that the description and specific examples are intended for purposes of illustration only and are not intended to limit the scope of the present claims.

DRAWINGS

The drawings described herein are for illustration purposes only and are not intended to limit the present teachings in any way.

FIG. 5 is a schematic view of an alternate fluid-injection mechanization according to the present teachings;

FIG. 6 is a schematic view of yet another alternate fluid-injection mechanization according to the present teachings;

FIG. 12 is a schematic view of a compressor with an integral liquid/gas separator suitable for use in the refrigeration systems according to the present teachings; and FIG. 13 is a schematic view of a compressor with an internal liquid/gas separator and an integral cooling-liquid heat exchanger and gas cooler suitable for use in the refrigeration systems according to the present teachings.

DETAILED DESCRIPTION

Figure 1:
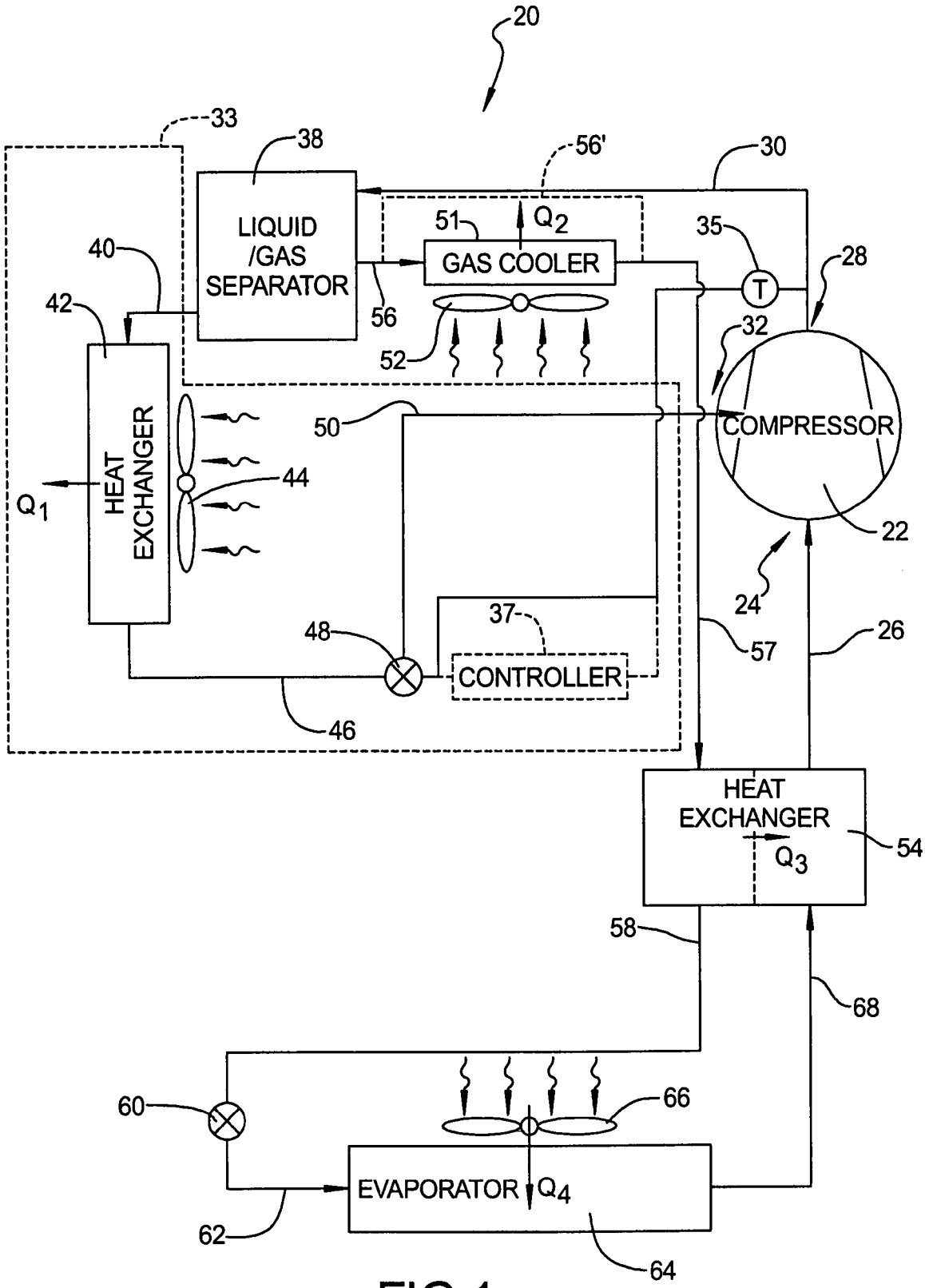
FIG. 1 is a schematic view of a refrigeration system according to the present teachings.

The following description is merely exemplary in nature and is not intended to limit the present disclosure, application, or uses. It should be understood that throughout the drawings, corresponding reference numerals (e.g., 20, 120, 220, 320 and 30, 130, 230, 330, etc.) indicate like or corresponding parts and features.

Referring to FIG. 1, a refrigeration system 20 according to the present teachings is shown. Refrigeration system 20 is a vapor-compression refrigeration system that may be configured for a trans-critical refrigeration cycle wherein the refrigerant is at a pressure above its critical pressure during a part of the cycle, thus being in the gaseous form regardless of the temperature, and is below its critical pressure in the other parts of the cycle, thereby enabling the refrigerant to be in vapor or liquid form. The refrigerant can be carbon dioxide ($CO_2$) and other refrigerants. The system may also be used at non-trans-critical operating conditions.

Refrigeration system 20 includes a compressor 22 that compresses refrigerant flowing therethrough from a suction pressure to a discharge pressure. When refrigeration system 20 is a trans-critical refrigeration cycle, the suction pressure is less than the critical pressure of the refrigerant while the discharge pressure is greater than the critical pressure of the refrigerant. Compressor 22 may be a single-stage positive displacement compressor, such as a scroll compressor. Alternatively, other positive displacement-type compressors may be used, such as screw compressors, two-stage rotary compressors, and two-stage reciprocating piston compressors.

Compressor 22 includes an inlet/suction port 24 in communication with a suction line 26 to supply refrigerant to the suction or low-pressure side of compressor 22. Compressor 22 includes an outlet/discharge port 28 in communication with a discharge line 30 that receives compressed refrigerant from the discharge chamber of compressor 22. Compressor 22 may include an intermediate-pressure port 32 that communicates with the compression cavities of compressor 22 at a location that corresponds to an intermediate pressure between the discharge pressure and the suction pressure. Intermediate-pressure port 32 supplies a fluid to the compression cavities of compressor 22 at an intermediate-pressure location.

In refrigeration system 20, a cooling-liquid injection system 33 is used to inject a cooling liquid into the compression cavities at an intermediate-pressure location through intermediate-pressure port 32, as described below. The cooling liquid, which is in a single-phase liquid state throughout the refrigeration cycle, may be a lubricant or oil, such as different types of mineral oil, or synthetic oils like, but not limited to, polyolester (POE), polyalkyleneglycol (PAG), alkylbenzene, polyalfaolefin (PAO) oils. In certain conditions other fluids, like water or mercury, may be used.

Discharge line 30 communicates with a gas/liquid separator 38. Discharge line 30 may route the high-temperature, high-pressure fluid discharged by compressor 22 directly from discharge port 28 to separator 38. The fluid discharged from compressor 22 includes both refrigerant, in gaseous form, and the injected cooling liquid. Separator 38, which may be approximately at the discharge pressure and temperature of compressor 22, receives discharged refrigerant above the critical pressure and in gaseous form regardless of the temperature within separator 38. The cooling liquid, however, maintains a single-phase form throughout the refrigeration cycle. Within separator 38, the refrigerant is separated from the cooling liquid which is utilized to cool the compressing process and absorb the heat of compression associated with compressor 22 compressing the refrigerant flowing therethrough.

The cooling-liquid injection system 33 may include a high-temperature cooling-liquid line 40, a heat exchanger 42, a fan or blower 44, a low-temperature cooling-liquid line 46, a throttle/expansion device 48, and an injection line 50. The separated high-temperature cooling liquid flows from separator 38 through high-temperature cooling-liquid line 40 and into heat exchanger 42. Within heat exchanger 42, heat $Q_1$ is extracted from the cooling liquid and transferred to ambient. Fan or blower 44 can facilitate the heat transfer by flowing ambient air across heat exchanger 42 in heat-conducting relation with the cooling liquid flowing therethrough. Alternatively, heat exchanger 42 may be a liquid-liquid heat exchanger, such as when refrigeration system 20 is used as a heat pump system, wherein the heat $Q_1$ can be used to heat water flowing through the heat pump system.

The cooling liquid exits heat exchanger 42 as a high-pressure, low-temperature liquid through low-temperature cooling-liquid line 46. Throttle device 48 interconnects low-temperature cooling-liquid line 46 with injection line 50. The reduced-pressure cooling liquid flows from throttle device 48 to intermediate-pressure port 32 through an injection line 50 for injection into the compression cavities that communicate with intermediate-pressure port 32. The cooling liquid is injected into compressor 22 to extract the heat created by compressing the refrigerant flowing therethrough. The heat can be discharged to the ambient as heat $Q_1$ by heat exchanger 42. Throttle device 48 controls the flow therethrough and reduces the pressure of the cooling liquid to a pressure less than the discharge pressure but greater than the intermediate pressure of the compression cavities that communicate with intermediate-pressure port 32. Throttle device 48, which may take a variety of forms, may be dynamic, static, or quasi-static. For example, throttle device 48 may be an adjustable valve, a fixed orifice, a pressure regulator, or the like. When dynamic, throttle device 48 may vary the amount of cooling liquid flowing therethrough and injected into compressor 22 through intermediate-pressure port 32 based on operation of refrigeration system 20, operation of compressor 22, to achieve desired operation of refrigeration system 20, and/or to achieve a desired operation of compressor 22. By way of non-limiting example, throttle device 48 may adjust the flow of cooling liquid therethrough to achieve a desired discharge temperature of the refrigerant exiting discharge port 28.

For temperature-based regulation of the cooling liquid flowing through throttle device 48, a temperature-sensing device 35 may be used to detect the temperature of the refrigerant being discharged by compressor 22. The output of temperature-sensing device 35 may be monitored to regulate the flow of cooling liquid through injection line 50. The cooling-liquid flow may be regulated with throttle device 48 to achieve a desired exit temperature or exit temperature range for the refrigerant discharged by compressor 22. For example, when the refrigerant is $CO_2$, it can be preferred to have a discharge temperature less than about 260 degrees Fahrenheit. As another example, when the refrigerant is $CO_2$, it can be preferable to maintain the discharge temperature between about 200 degrees Fahrenheit and up to about 250 degrees Fahrenheit. Throttle device 48 may adjust the flow therethrough in response to the output of temperature-sensing device 35 to compensate for changing operation of compressor 22 and/or refrigeration system 20. A thermal expansion valve that is in thermal communication with the refrigerant being discharged by compressor 22 may be utilized as a temperature-compensating throttle device 48. The thermal expansion valve may automatically adjust its position (e.g., fully opened, fully or approximately closed, or at an intermediate position therebetween) based on the temperature of the refrigerant being discharged by compressor 22 to achieve a desired exit temperature or range. Optionally, a controller 37 may monitor the temperature reported by a temperature-sensing device 35 and adjust operation of throttle device 48 based on the sensed temperature to maintain the desired discharge temperature or temperature range for the refrigerant being discharged by compressor 22.

Within separator 38, the pressure typically remains above the critical pressure in trans-critical operating case, and the temperature typically remains above the saturation temperature for that pressure in the sub-critical case of operation. As a result, the refrigerant therein remains in gaseous form. The high-temperature, high-pressure gaseous refrigerant flows from separator 38 to a gas cooler 51 through high-temperature, high-pressure line 56. Within gas cooler 51, heat $Q_2$ is transferred from the high-temperature, high-pressure refrigerant to ambient. A fan or blower 52 can facilitate the heat transfer by flowing ambient air across gas cooler 51 in heat-conducting relation with the refrigerant flowing therethrough. Alternatively, gas cooler 51 may be a liquid-liquid heat exchanger, such as when refrigeration system 20 is used as a heat pump system, wherein the heat $Q_2$ can be used to heat water flowing through the heat pump system.

The refrigerant exits gas cooler 51 at a reduced temperature but still at a pressure above critical and, as a result, the refrigerant remains in gaseous form. When a suction-line heat exchanger is provided to further pre-cool the gas and superheat the suction gas returning to the compressor, the gaseous refrigerant flowing from gas cooler 51 may flow to a suction-line heat exchanger 54 through line 57. Within heat exchanger 54, heat $Q_3$ is transferred from the high-pressure refrigerant to low-temperature, low-pressure refrigerant flowing to the suction side of compressor 22. The transfer of heat $Q_3$ reduces the temperature of the high-pressure refrigerant, which may increase the heat-absorbing capacity in the evaporator. The high-pressure refrigerant exiting heat exchanger 54 may remain above the critical pressure. (When the gas is above its critical temperature it may not be anything but gaseous at any pressure, but below critical temperature it may be liquid even if above critical pressure.)

A reduced-temperature, high-pressure line 58 directs the high-pressure refrigerant from heat exchanger 54 to a main throttle device 60. The refrigerant flowing through throttle device 60 expands and a further reduction in temperature and pressure occurs. Throttle device 60 can be dynamically controlled to compensate for a varying load placed on refrigeration system 20. Alternatively, throttle device 60 can be static.

The low-pressure refrigerant downstream of throttle device 60 at this point of the circuit is desirably at a sub-critical temperature and at a pressure below its critical pressure, resulting in a two-phase refrigerant flow. A low-pressure line 62 directs the refrigerant flowing through throttle device 60 to evaporator 64, where the two-phase, low-pressure refrigerant absorbs heat $Q_4$ from the fluid flowing over evaporator 64. For example, heat $Q_4$ can be extracted from an air stream induced to flow over evaporator 64 by a fan or blower 66. The liquid portion of refrigerant within evaporator 64 boils off as heat $Q_4$ is absorbed. Near the end of the evaporator 64 as the liquid phase is boiled off, the temperature of the refrigerant increases and exits evaporator 64 through a low-pressure line 68, which directs the refrigerant into suction-line heat exchanger 54, when it is so provided, wherein the temperature of the refrigerant further increases by the transfer of heat $Q_3$, prior to flowing into compressor 22 through suction line 26.

In operation, the low-pressure (suction pressure) refrigerant exiting suction-line heat exchanger 54 is sucked into the compression cavities of compressor 22 through suction line 26 and suction port 24. The compression members within compressor 22, such as the scrolls in the case of a scroll compressor, compress the refrigerant from the suction pressure to the discharge pressure. During the compressing process, cooling liquid is injected into the compression cavities at an intermediate-pressure location through injection line 50.

The specific quantity of cooling liquid injected into the compression cavities can vary based on factors including, but not limited to, the demand placed on refrigeration system 20, the type of refrigerant utilized therein, the type and configuration of compressor 22, the efficiency of the compressor, the suction and discharge pressures, the heat capacity of the cooling liquid, and the ability of the selected cooling liquid to absorb the refrigerant at different pressures and temperatures. Injecting larger amounts of cooling liquid into the working chamber of the compressor allows the working process to approach a quasi isothermal compression process. However, the cooling-liquid injection process can also be associated with additional losses caused by the energy required to pump the cooling-liquid to a higher pressure, increased throttling of the cooling liquid before injection into the compression cavities, and parasitic recompression of refrigerant through dissolution in the cooling liquid under high pressure and release at a lower pressure. It is understood to those skilled in the art that for a given operational condition, selected working fluids, and compressor parameters there is an optimal range of cooling liquid volume that may be injected in order to achieve the desired refrigeration system performance given that the discharge gas may not exceed a maximum allowable temperature.

The quantity of cooling liquid injected into the compression cavities at the intermediate-pressure location may absorb a significant amount of the heat generated by the compression process. As a result, there may be a minimal or no need to further cool the discharged refrigerant as adequate cooling may be achieved with the cooling liquid and the absorbed heat may be released in heat exchanger 42, which extracts heat $Q_1$ from the cooling liquid flowing therethrough. The ability to remove the heat generated by the compression process with the injected cooling liquid may eliminate the need for a discharge gas cooler or condenser to reduce the discharge gas temperature prior to flowing through the rest of the refrigeration system. When this is the case, gas cooler 51 is not needed and line 56' (shown in phantom) directs the high-pressure refrigerant to line 57. Thus, the use of injected cooling liquid, which may enable the compression process to approach quasi-isothermal compression within compressor 22, may also simplify the design of refrigeration system 20 and enable a significant portion of the compression heat to be absorbed by the injected cooling liquid and rejected through heat exchanger 42.

Because the injected cooling liquid significantly reduces the temperatures associated with the compression process, compressor 22 is relieved from excessive temperatures and the compression process temperatures are less dependent on the temperature of the refrigerant entering the suction side of compressor 22 through suction port 24. By reducing this dependency on compression process temperatures, a suction-line heat exchanger 54 may be used to improve the refrigeration cycle efficiency. Furthermore, the presence of the injected cooling liquid during the compression process promotes sealing the gaps separating the compression cavities during the compression process, which may further reduce the compression work needed to compress the refrigerant from a suction pressure to a discharge pressure. Thus, cooling-liquid injection system 33 can be a beneficial addition to refrigeration system 20.

Figure 2:
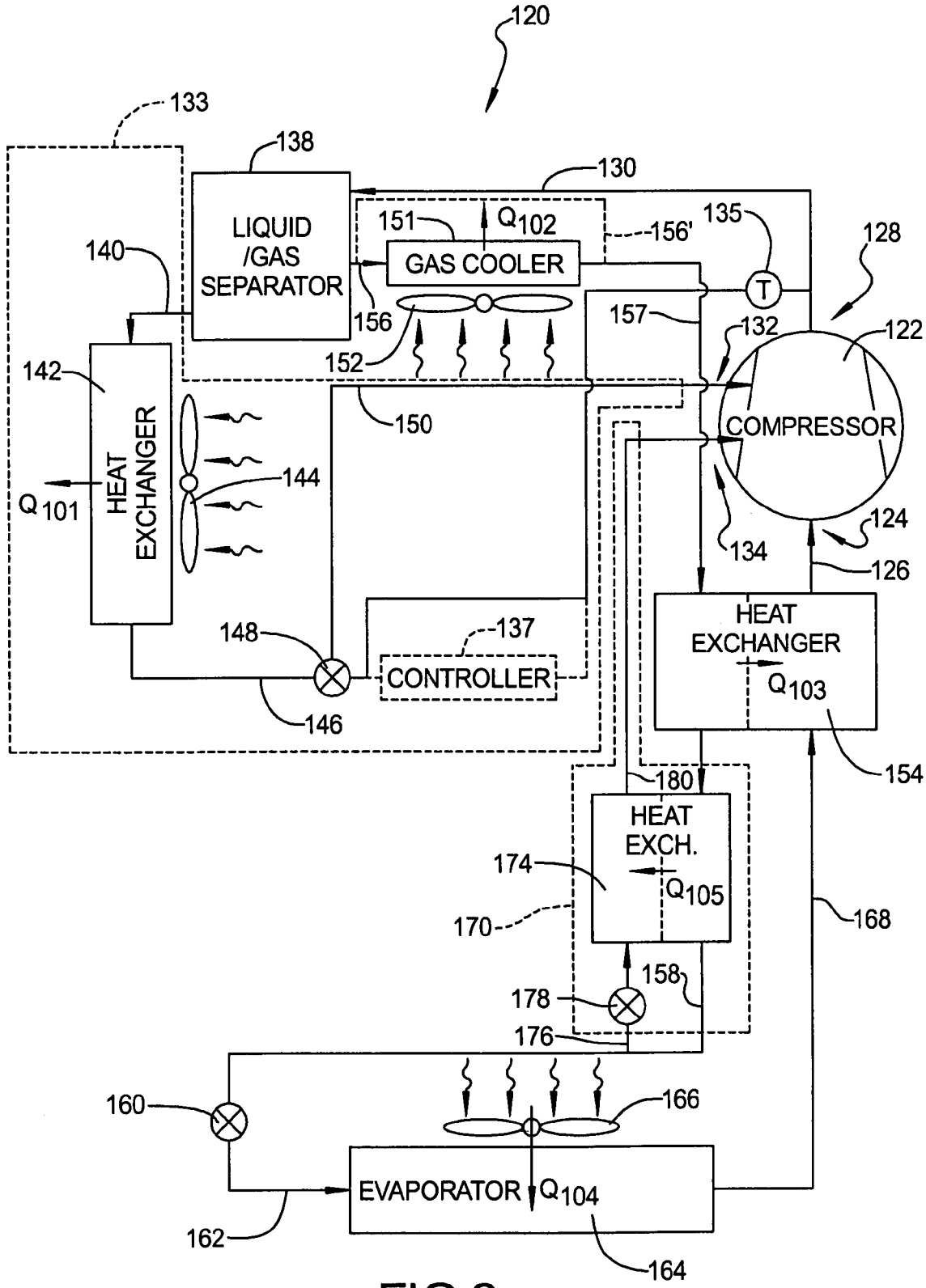
FIG. 2 is a schematic view of another refrigeration system according to the present teachings.

Referring now to FIG. 2, a refrigeration system 120 according to the present teachings is shown. Refrigeration system 120 is similar to refrigeration system 20, discussed above and shown in FIG. 1, with the addition of an economizer system 170. As such, refrigeration system 120 includes a compressor 122 having inlet and outlet ports 124, 128 respectively connected to suction and discharge lines 126, 130. Refrigerant and cooling liquid discharged by compressor 122 flows through a liquid/gas separator 138 wherein the cooling liquid is removed through line 140 and routed through heat exchanger 142. A fan or blower 144 may facilitate the removal of heat $Q_{101}$ from the cooling liquid in heat exchanger 142. The reduced-temperature cooling liquid exits heat exchanger 142 through line 146, flows through a throttle/expansion device 148, and is injected into the pressure cavities at an intermediate-pressure location through line 150 and intermediate-pressure port 132. Expansion device 148 can be the same as expansion device 48 and can be operated in the same manner. As such, a controller 137 can be coupled to a temperature-sensing device 135 to control the opening and closing of throttle device 148.

Gaseous refrigerant flows from separator 138 into gas cooler 151 through line 156. Gas cooler 151 transfers heat $Q_{102}$ from the refrigerant flowing therethrough to ambient. A fan or blower 152 may facilitate the removal of heat $Q_{102}$ from the refrigerant flowing through gas cooler 151. Optionally, if a gas cooler is not utilized, refrigerant exits separator 138 and flows directly to line 157 through line 156' (shown in phantom). Refrigerant exiting gas cooler 151 flows into suction-line heat exchanger 154 through line 157. Heat exchanger 154 transfers heat $Q_{103}$ from the refrigerant flowing therethrough from line 157 to refrigerant flowing through the lower pressure side of heat exchanger 154 from line 168.

Refrigeration system 120 also includes a main throttle/expansion device 160 that expands the refrigerant on its way to evaporator 164 through line 162. In evaporator 164, heat $Q_{104}$ is transferred from a fluid flowing over evaporator 164 and into the refrigerant flowing therethrough. A fan or blower 166 may facilitate the fluid flow over the exterior of evaporator 164. The refrigerant exits evaporator 164 and flows to suction-line heat exchanger 154 through line 168.

Refrigeration system 120 differs from refrigeration system 20 by including an economizer system 170, which may further reduce the operational temperature of the refrigerant prior to flowing through main expansion device 160 thereby increasing its capacity to absorb heat in evaporator 164 and increasing the cooling capacity of refrigeration system 120. Economizer system 170 injects refrigerant, in vapor form, directly into the compression cavities at an intermediate-pressure location. While similarities and differences between refrigeration system 20 and refrigeration system 120 will be discussed, other similarities and differences may exist.

Compressor 122 may include a second intermediate-pressure port 134 for injection of refrigerant vapor into the compression cavities at an intermediate-pressure location. The use of separate intermediate-pressure ports 132, 134 allows the refrigerant-vapor injection to be kept separate from the cooling-liquid injection. The use of separate injection ports may also reduce or eliminate the need to control injection of the cooling liquid and the refrigerant vapor because the injection pressures and flow rates would not necessarily be coordinated. Additionally, the potential for backflow of one fluid into the sources of the other flow may also be reduced and/or eliminated. Thus, separate injection ports allow cooling liquid and vapor injection to occur at different locations and at different intermediate-pressure levels can be used.

Economizer system 170 may include an economizer heat exchanger 174 disposed in-line with high-pressure line 158. A portion of the refrigerant flowing through line 158 downstream of a high-pressure side of economizer heat exchanger 174 may be routed through an economizer line 176, expanded in an economizer throttle device 178 and directed into a reduced-pressure side of economizer heat exchanger 174. The portion of the refrigerant flowing through economizer throttle device 178 is expanded such that it can absorb heat $Q_{105}$ from the high-pressure gaseous refrigerant flowing through the high-pressure side of heat exchanger 174. The refrigerant expanded across throttle device 178 should be cool enough to be a two-phase mixture. The transfer of heat $Q_{105}$ from the main refrigerant flow decreases the temperature prior to encountering main throttle device 160 and flowing onto evaporator 164 via line 162, thereby increasing the heat absorbing capacity of the refrigerant and improving the performance of evaporator 164. The refrigerant exits evaporator 164 through line 168 and flows into an optional suction-line heat exchanger 154 to absorb heat $Q_{103}$.

The expanded and heated refrigerant vapor exiting economizer heat exchanger 174 flows through vapor-injection line 180 to second intermediate-pressure port 134 for injection into the compression cavities at an intermediate-pressure location. The refrigerant flow rate injected into the compression cavities at an intermediate-pressure location through vapor-injection line 180 may be equal to or greater than the refrigerant flow rate into the suction port 124 of compressor 122 through suction line 126. Throttle device 178 maintains the pressure in vapor-injection line 180 above the pressure at the intermediate-pressure location of the compression cavities that communicate with second intermediate-pressure port 134. Throttle device 178 may be a dynamic device or a static device, as desired, to provide a desired economizer effect. Refrigerant-vapor injection at an intermediate pressure reduces the amount of energy used by compressor 122 to compress the injected vapor to discharge pressure, thereby reducing the specific work improving compressor efficiency.

Refrigeration system 120 includes injection of a cooling liquid into the compression cavities at an intermediate-pressure location and injection of refrigerant vapor into the compression cavities at another intermediate-pressure location. Cooling-liquid injection and vapor-refrigerant injection improve refrigeration system 120 efficiency by increasing the performance of compressor 122 and evaporator 164. The injection of the cooling liquid can reduce the impact of an increased temperature of the suction gas caused by the use of suction gas heat exchanger 154. Lowering the temperature of the compressed refrigerant discharged by compressor 122 facilitates the use of an economizer system 170 to further reduce the temperature of the refrigerant prior to flowing through the main throttle device 160 and evaporator 164. The reduced discharge temperature enables economizer system 170 to further reduce the refrigerant temperature to a temperature lower than that achieved with a refrigerant discharged at a higher temperature. Thus, the combination of a vapor-injection economizer system 170 and cooling-liquid injection system 133 may provide a more economical and efficient refrigeration system 120.

Figure 3:
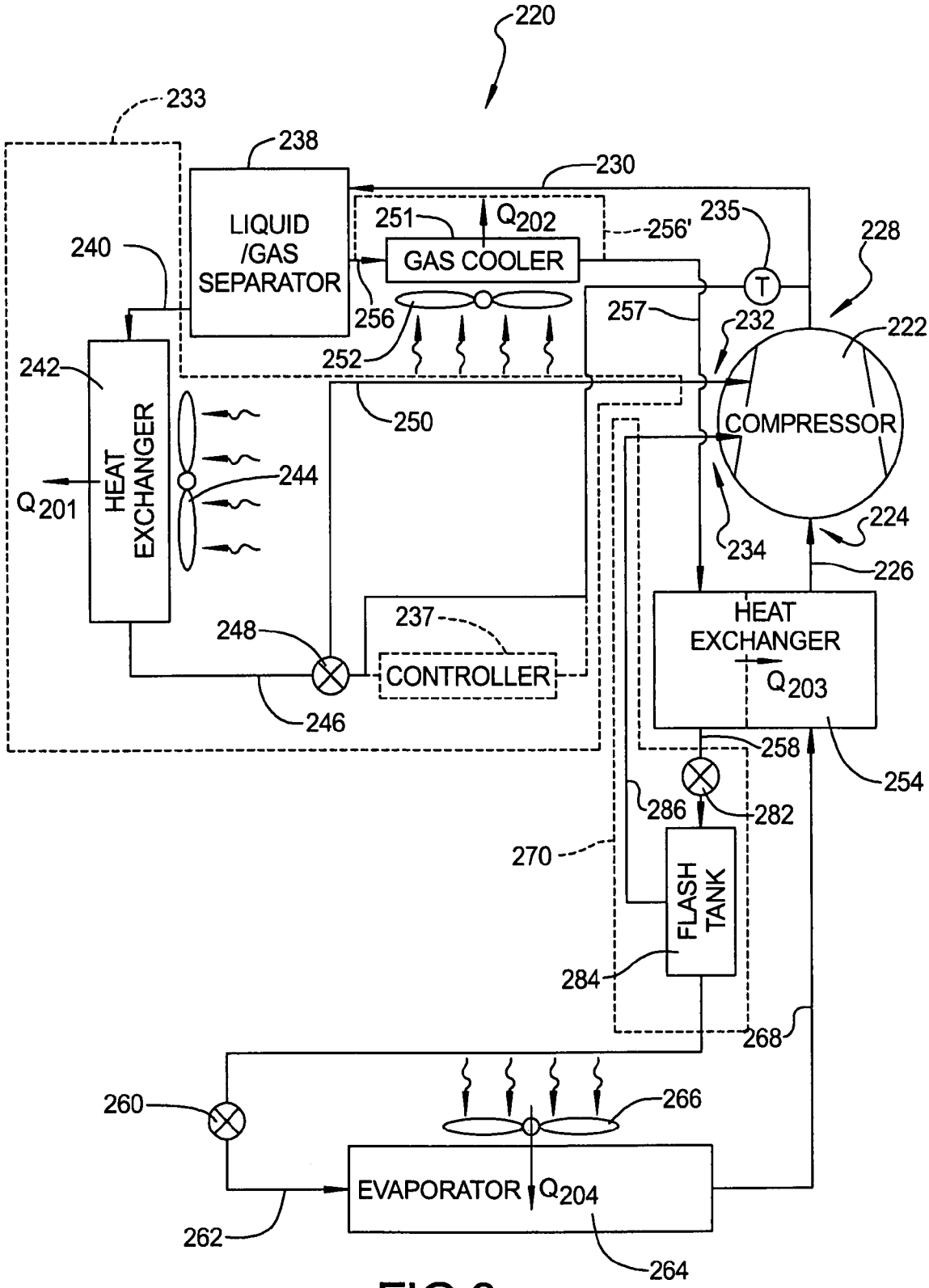
FIG. 3 is a schematic view of yet another refrigeration system according to the present teachings.

Referring now to FIG. 3, a refrigeration system 220 according to the present teachings is shown. Refrigeration system 220 is similar to refrigeration system 120 discussed above with reference to FIG. 2. As such, refrigeration system 220 includes a compressor 222 having inlet and outlet ports 224, 228 respectively connected to suction and discharge lines 226, 230. Refrigerant and cooling liquid discharged by compressor 222 flows through a liquid/gas separator 238 wherein the cooling liquid is removed through line 240 and routed through heat exchanger 242. A fan or blower 244 may facilitate the removal of heat $Q_{201}$ from the cooling liquid in heat exchanger 242. The reduced-temperature cooling liquid exits heat exchanger 242 through line 246, flows through a throttle/expansion device 248, and is injected into the pressure cavities at an intermediate-pressure location through line 250 and intermediate-pressure port 232. Expansion device 248 can be the same as expansion device 148 and can be operated in the same manner. As such, a controller 237 can be coupled to a temperature-sensing device 235 to control the opening and closing of throttle device 248.

Gaseous refrigerant flows from separator 238 into gas cooler 251 through line 256. Gas cooler 251 transfers heat $Q_{202}$ from the refrigerant flowing therethrough to ambient. A fan or blower 252 may facilitate the removal of heat $Q_{202}$ from the refrigerant flowing through gas cooler 251. Optionally, if a gas cooler is not utilized, refrigerant exits separator 238 and flows directly to line 257 through line 256' (shown in phantom). Refrigerant exiting gas cooler 251 flows into suction-line heat exchanger 254 through line 257. Heat exchanger 254 transfers heat $Q_{203}$ from the refrigerant flowing therethrough from line 257 to refrigerant flowing through the lower pressure side of heat exchanger 254 from line 268.

Refrigeration system 220 also includes a main throttle device 260 that expands the refrigerant on its way to evaporator 264 through line 262. In evaporator 264, heat $Q_{204}$ is transferred from a fluid flowing over evaporator 264 and into the refrigerant flowing therethrough. A fan or blower 266 may facilitate the fluid flow over the exterior of evaporator 264. The refrigerant exits evaporator 264 and flows to suction-line heat exchanger 254 through line 268.

Refrigeration system 220 includes both cooling-liquid injection and refrigerant-vapor injection into the compression cavities of compressor 222 at intermediate-pressure locations. Refrigeration system 220, however, may use a different economizer system 270 than refrigeration system 120. While similarities and differences between refrigeration system 220 and refrigeration system 120 will be discussed, other similarities and differences may exist.

In refrigeration system 220, high-pressure line 258 includes a throttle device 282 and a flash tank 284 downstream of suction-line heat exchanger 254. The high-pressure refrigerant flowing through throttle device 282 and into flash tank 284 is expanded to reduce the pressure to a sub-critical pressure and form a two-phase refrigerant flow. Throttle device 282 reduces the pressure of the refrigerant flowing therethrough to a pressure that is between the suction and discharge pressures of compressor 222 and is greater than the intermediate pressure in the compression cavities that communicate with second intermediate-pressure port 234. Throttle device 282 may be dynamic or static.

In flash tank 284 the gaseous refrigerant can be separated from the liquid refrigerant and may be routed to second intermediate-pressure port 234 through vapor-injection line 286 for injection into the compression cavities at an intermediate-pressure location. The refrigerant flow rate injected into the compression cavities at an intermediate-pressure location through vapor-injection line 286 may be equal to or greater than the refrigerant flow rate into the suction port 224 of compressor 222 through suction line 226. The liquid refrigerant in flash tank 284 may continue through line 258 and through main throttle device 260 and into evaporator 264 through line 262. The refrigerant within evaporator 264 absorbs heat $Q_{204}$ and returns to gaseous form. The refrigerant flows, via line 268, from evaporator 264 to suction-line heat exchanger 254, absorbs heat $Q_{203}$ from refrigerant flowing to suction-line heat exchanger 254 through line 257, and flows into the suction side of compressor 222 through suction line 226 and suction port 224.

Refrigeration system 220 utilizes both cooling-liquid injection system 233 to inject cooling liquid into compressor 222 and economizer system 270 to inject vapor-refrigerant into compressor 222 to increase the efficiency and/or the cooling capacity of compressor 222 and improve the performance of refrigeration system 220. Thus, refrigeration system 220 may include cooling-liquid injection and refrigerant-vapor injection into the pressure cavities at different intermediate-pressure locations.

Figure 4:
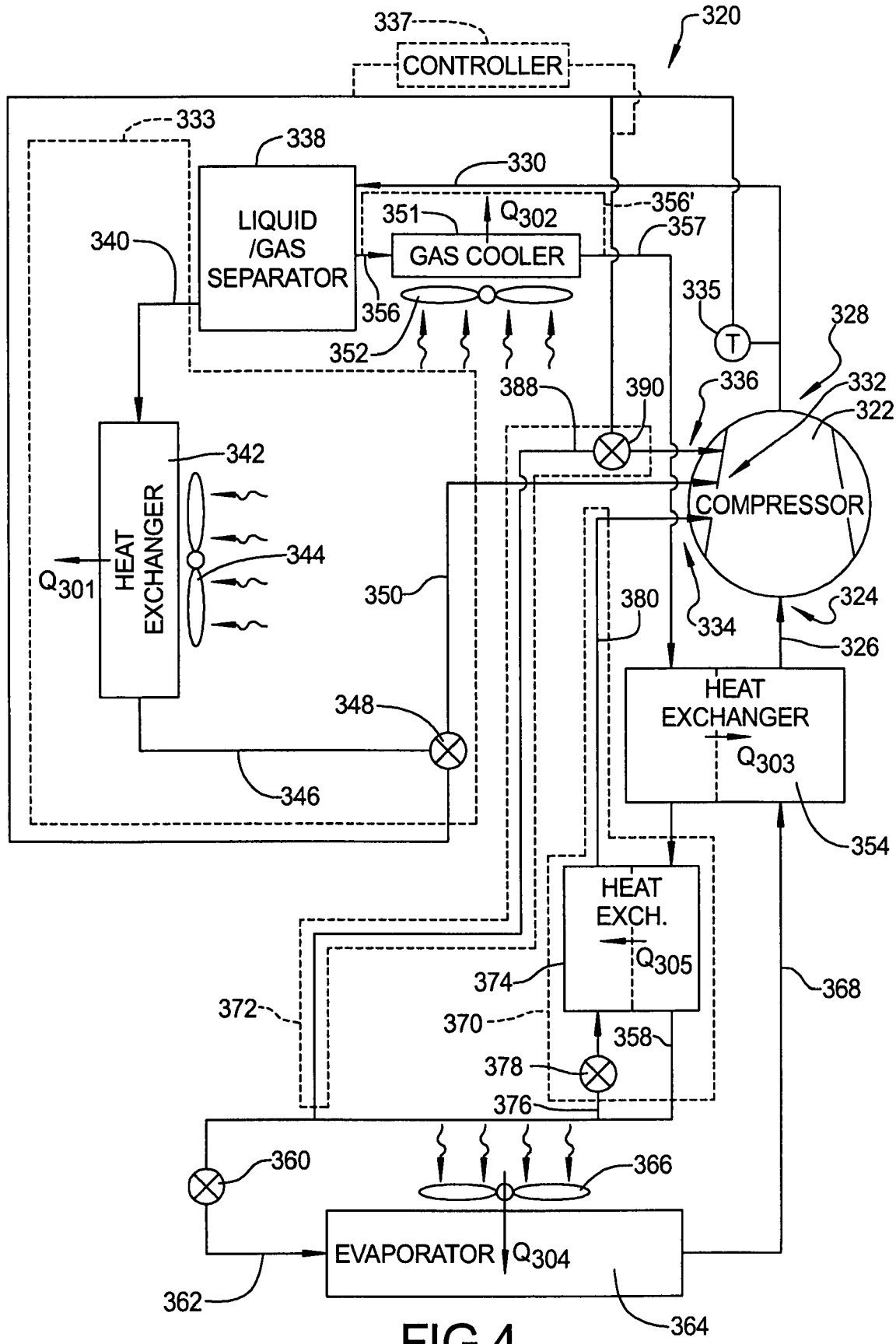
FIG. 4 is a schematic view of still another refrigeration system according to the present teachings.

Referring now to FIG. 4, another refrigeration system 320 according to the present teachings is shown. Refrigeration system 320 is similar to refrigeration system 120, discussed above and shown in FIG. 2, and includes a cooling-liquid injection system 333, an economizer system 370, and adds a liquid-refrigerant injection system 372. While the similarities and differences between refrigeration system 320 and refrigeration system 120 will be discussed, other similarities and differences may exist.

Refrigeration system 320 includes a compressor 322 having inlet and discharge ports 324, 328 coupled to suction and discharge lines 326, 330, respectively. Compressor 322 includes intermediate-pressure port 332 that communicates with cooling-liquid injection line 350 to receive the cooling liquid. The discharge line 330 communicates with a gas/liquid separator 338, which separates the cooling liquid from the refrigerant and transfers the cooling liquid to heat exchanger 342 through line 340 to remove heat $Q_{301}$ from the cooling liquid. A fan or blower 344 may facilitate the heat removal. The reduced-temperature cooling liquid exits heat exchanger 342 through line 346, flows through a throttle/expansion device 348, and is injected into the pressure cavities at an intermediate-pressure location through line 350 and intermediate-pressure port 332. Expansion device 348 can be the same as expansion device 148 and can be operated in the same manner. As such, a controller 337 can be coupled to a temperature-sensing device 335 to control the opening and closing of throttle device 348.

Gaseous refrigerant flows from separator 338 into gas cooler 351 through line 356. Gas cooler 351 transfers heat $Q_{302}$ from the refrigerant flowing therethrough to ambient. A fan or blower 352 may facilitate the removal of heat $Q_{302}$ from the refrigerant flowing through gas cooler 351. Optionally, if a gas cooler is not utilized, refrigerant exits separator 338 and flows directly to line 357 through line 356' (shown in phantom). Refrigerant exiting gas cooler 351 flows into suction-line heat exchanger 354 through line 357. Within heat exchanger 354, heat $Q_{303}$ is transferred from the high-pressure refrigerant to low-pressure refrigerant flowing from evaporator 364 through line 368 and through the low-pressure side of suction-line heat exchanger 354. The increased-temperature refrigerant flows from suction-line heat exchanger 354 into the suction side of compressor 322 through inlet port 324 and suction line 326.

Refrigeration system 320 may include economizer system 370, which may include an economizer heat exchanger 374 disposed in-line with high-pressure line 358. A portion of the refrigerant flowing through line 358 downstream of a high-pressure side of economizer heat exchanger 374 may be routed through an economizer line 376, expanded in an economizer throttle device 378, and directed into a reduced-pressure side of economizer heat exchanger 374 wherein the expanded refrigerant absorbs heat $Q_{305}$ from the high-pressure refrigerant flowing through the high-pressure side of economizer heat exchanger 374. The expanded and heated refrigerant vapor exiting economizer heat exchanger 374 flows to second intermediate-pressure port 334 through vapor-injection line 380 and is injected into the compression cavities at an intermediate-pressure location. The refrigerant flow rate injected into the compression cavities at an intermediate-pressure location through vapor-injection line 380 may be equal to or greater than the refrigerant flow rate into the suction port 324 of compressor 322 through suction line 326.

The main stream of the refrigerant flowing through line 358 flows through a main throttle device 360 and into evaporator 364 through low-pressure line 362. The refrigerant flowing through evaporator 364 absorbs heat $Q_{304}$ from the fluid flowing over the exterior of evaporator 364. A fan or blower 366 can facilitate the heat transfer $Q_{304}$ by inducing the fluid flow over evaporator 364. The refrigerant exits evaporator 364 and flows to suction-line heat exchanger 354 through line 368.

Refrigeration system 320 includes a liquid-refrigerant injection system 372 to inject liquid refrigerant into the compression cavities of compressor 322 at an intermediate-pressure location. The injected liquid refrigerant may reduce the temperature of the compression process and the temperature of the refrigerant discharged by compressor 322. Compressor 322 may include a third intermediate-pressure port 336 for injecting the liquid refrigerant directly into the compression cavities at an intermediate-pressure location. Liquid-refrigerant injection system 372 may include a liquid-refrigerant injection line 388 in fluid communication with intermediate-pressure port 336 and with high-pressure line 358. Liquid-refrigerant injection line 388 may communicate with line 358 upstream or downstream of economizer line 376.

A throttle device 390 may be disposed in line 388 to regulate the flow of liquid refrigerant therethrough. A portion of the refrigerant flowing through line 358, after having passed through the high-pressure side of economizer heat exchanger 374, may be routed through liquid-refrigerant injection line 388, expanded in throttle device 390, and directed into the compression cavities of compressor 322 at an intermediate-pressure location through intermediate-pressure port 336. After passing through throttle device 390, the refrigerant pressure is greater than the pressure in the compression cavity in fluid communication with intermediate-pressure port 336. The expansion of the refrigerant flowing through throttle device 390 may cause the refrigerant to take an entirely liquid form, or a two-phase form that is predominantly liquid in a relatively low enthalpy state.

Throttle device 390 may be dynamic, static, or quasi-static. For example, throttle device 390 may be an adjustable valve, a fixed orifice, a variable orifice, a pressure regulator, and the like. When dynamic, throttle device 390 may vary the amount of refrigerant flowing therethrough and injected into compressor 322 through intermediate-pressure port 336 based on operation of refrigeration system 320, operation of compressor 322, to achieve a desired operation of refrigeration system 320, and/or to achieve a desired operation of compressor 322. By way of non-limiting example, throttle device 390 may adjust the flow of refrigerant therethrough to achieve a desired discharge temperature or range of discharge temperature of the refrigerant exiting discharge port 328.

For temperature-based regulation of the refrigerant flow through throttle device 390, temperature-sensing device 335 may be used to detect the temperature of the refrigerant being discharged by compressor 322. The output of temperature-sensing device 335 may be monitored to regulate the flow of refrigerant through liquid-refrigerant injection line 388. The refrigerant flow may be regulated to achieve a desired exit temperature (preferably less than about 260 degrees Fahrenheit in the case of $CO_2$) or exit temperature range (preferably between about 200 degrees Fahrenheit to about 250 degrees Fahrenheit, in the case of $CO_2$) for the refrigerant discharged by compressor 322. Throttle device 390 may adjust the flow therethrough in response to the output of temperature-sensing device 335 to compensate for changing operation of compressor 322 and/or refrigeration system 320. A thermal expansion valve that is in thermal communication with the refrigerant being discharged by compressor 322 may be utilized as a temperature compensating throttle device 390. The thermal expansion valve may automatically adjust its position (e.g., fully opened, fully or approximately closed, or at an intermediate position therebetween) based on the temperature of the refrigerant being discharged by compressor 322 to achieve a desired exit temperature or range. Controller 337 may monitor the temperature reported by temperature-sensing device 335 and adjust operation of throttle device 390 based on the sensed temperature to maintain the desired discharge temperature or temperature range for the refrigerant being discharged by compressor 322.

When cooling-liquid injection system 333 uses an actively controlled throttle device 348, controller 337 can control and coordinate the operation of throttle device 348 and throttle device 390 to coordinate the cooling-liquid injection and liquid-refrigerant injection into the compression cavities of compressor 322 to achieve a desired operational state. For example, controller 337 can stage the injection of the cooling liquid and the liquid refrigerant such that one of the fluid injections provides the primary cooling and the other fluid injection provides supplemental cooling as needed. When this is the case, controller 337 can use the cooling-liquid injection as the primary cooling means and actively control throttle device 348 to adjust the flow of the cooling liquid injected into compressor 322 to achieve a desired refrigerant discharge temperature as reported by temperature-sensing device 335. Controller 337 would maintain throttle device 390 closed so long as the injection of the cooling liquid is able to achieve the desired refrigerant discharge temperature. In the event that the cooling-liquid injection is unable to meet the desired refrigerant discharge temperature, controller 337 can command throttle device 390 to open and allow liquid refrigerant to be injected into compressor 322 to provide additional cooling and achieve the desired refrigerant discharge temperature. In this manner, controller 337 utilizes the cooling liquid injection as the primary cooling means and supplements the cooling capability through the injection of liquid refrigerant.

In another control scenario, controller 337 can utilize cooling-liquid injection system 333 and liquid-refrigerant injection system 372 simultaneously to achieve a desired refrigerant discharge temperature. In this case, controller 337 actively controls the opening and closing of throttle devices 348, 390 to vary the quantity of cooling liquid and liquid refrigerant injected into the intermediate-pressure cavities of compressor 322. Controller 337 adjusts throttle devices 348, 390 based on the refrigerant discharge temperature sensed by temperature-sensing device 335.

In yet another control scenario, controller 337 can utilize liquid-refrigerant injection system 372 as the primary cooling means and supplement the cooling capability, as needed, with cooling-liquid injection system 333. In this case, controller 337 actively controls throttle device 390 to inject liquid refrigerant into the compression cavities of compressor 322 to achieve a desired refrigerant discharge temperature. If the liquid refrigerant injection is not sufficient to achieve the desired refrigerant discharge temperature, controller 337 commands throttle device 348 to open and close to provide cooling-liquid injection to supplement the cooling capability and achieve a desired refrigerant discharge temperature.

The injection of liquid refrigerant into the compression cavities at an intermediate-pressure location may reduce the efficiency of compressor 322. The reduced efficiency, however, may be outweighed by the advantages to refrigeration system 320 by a lower temperature refrigerant discharged by compressor 322. Additionally, any decrease in compressor efficiency caused by liquid-refrigerant injection may also be reduced and/or overcome by the advantages associated with the use of the cooling-liquid injection and/or vapor-refrigerant injection. Moreover, the injection of liquid refrigerant into the compression cavities of compressor 322 may be modulated or regulated to minimize any compromise to the efficiency of compressor 322 and/or refrigeration system 320 while providing a temperature reduction to refrigerant discharged by compressor 322. Best efficiency may be achieved by first injecting cooling-liquid and operating vapor injection to satisfy system cooling capacity requirement. If more cooling is required beyond maximum injection of cooling liquid (more extreme conditions) then liquid-refrigerant injection can be additionally applied, thus staging the cooling means.

In refrigeration system 320, three intermediate-pressure ports 332, 334, 336 may be used to inject a cooling liquid, vapor refrigerant, and liquid refrigerant, respectively, into the compression cavities of compressor 322 at intermediate-pressure locations. These three ports may communicate with the compression cavities at different intermediate-pressure locations and allow the associated fluid flows to be supplied to different intermediate-pressure locations. The use of intermediate-pressure injection ports 332, 334, 336 may isolate the fluids from one another prior to injection into the compression cavities. The use of separate injection ports 332, 334, 336 reduces or eliminates coordination of injection pressures of the respective fluids. Additionally, the potential for backflow of one of these flows into the other flow may also be reduced or eliminated by the use of separate injection ports 332, 334, 336.

Liquid refrigerant may be injected into the intermediate-pressure cavities at a location that is near the discharge port, where the most heat is generated by the compression process. As a result, injecting the liquid refrigerant into the pressure cavities at an intermediate-pressure location that is near the discharge port may provide the cooling where it is mostly needed. Moreover, injecting the liquid refrigerant near the discharge port can also reduce any parasitic impact on the amount of compressor work necessary to compress and discharge the injected liquid refrigerant.

The cooling liquid may be injected at a location near the discharge port due to the compression heat being greatest at or close to discharge. The cooling liquid can be injected at a location that corresponds to a higher or lower pressure than the location at which the liquid refrigerant is injected. Preferably, the cooling liquid is injected into a lower pressure location than the liquid refrigerant. Injecting the cooling liquid at a lower pressure location than that of the liquid refrigerant may enhance the lubricating and sealing properties of the cooling liquid.

The refrigerant vapor may be injected into the intermediate-pressure cavities at a location that corresponds to a lower pressure than where the liquid refrigerant is injected to enable injecting the amount of vapor needed to efficiently operate the refrigeration system 320 at the desired operational condition. This would also result in a lower enthalpy for the liquid separated in the flash tank and an associated increase in evaporator heat capacity.

In refrigeration system 320, the various fluid streams are separately injected into the compression cavities of compressor 322 at discrete intermediate-pressure locations. One or more of these fluids may be mixed or joined prior to injection into the compression cavities. For example, as shown in FIG. 5, a compressor 322' can have inlet and outlet ports 324', 328' that communicate with respective suction and discharge lines 326', 330'. Compressor 322' can compress a refrigerant flowing therethrough from a suction pressure to a discharge pressure. Compressor 322' can include first and second intermediate-pressure ports 332', 334' that communicate with different intermediate-pressure locations in compressor 322'. Refrigerant vapor can be injected into an intermediate-pressure location of compressor 322' through vapor-injection line 380' that communicates with second intermediate-pressure port 334'. The cooling liquid and liquid refrigerant can be injected into an intermediate-pressure location of compressor 322' through an injection line 382' that communicates with first intermediate-pressure port 332'.

In this case, cooling-liquid injection line 350' includes a backflow-prevention device 383' and communicates with injection line 382'. Similarly, liquid-refrigerant injection line 388' includes a backflow-prevention device 384' and also communicates with injection line 382'. With this arrangement, both the cooling liquid and the liquid refrigerant flow through injection line 382' to be injected into an intermediate-pressure location of compressor 322' through intermediate-pressure port 332'. Throttle devices 348', 390' regulate the respective flows of cooling liquid and liquid refrigerant into injection line 382'. Throttle devices 348', 390' can coordinate the respective flows therethrough to achieve a desired quantity of cooling liquid and liquid refrigerant injection into compressor 322'. Backflow-prevention devices 383', 384' prevent the backflow of one of the fluids into the other fluid line. Controller 337' can be utilized to control operation of throttle devices 348', 390' to coordinate the injections of the cooling liquid and liquid refrigerant.

As another example, as shown in FIG. 6, the vapor refrigerant, cooling liquid, and liquid refrigerant can all be injected into a compressor 322" through the same intermediate-pressure port 332". In this case, the vapor refrigerant, the cooling liquid, and the liquid refrigerant are all injected into compressor 322" through injection line 382" that communicates with intermediate-pressure port 332". Vapor-injection line 380" communicates with injection line 382" and includes a backflow-prevention device 385". Similarly, cooling-liquid injection line 350" communicates with injection line 382" and includes a backflow-prevention device 383". Also similarly, liquid-refrigerant injection line 388" communicates with injection line 382" and includes a backflow-prevention device 384". Throttle devices 378", 348", 390" regulate the respective flows of vapor refrigerant, cooling liquid, and liquid refrigerant into injection line 382". Throttle devices 378", 348", 390" can coordinate the respective flows therethrough to achieve a desired quantity of vapor refrigerant, cooling liquid, and liquid refrigerant injection into compressor 322". Backflow-prevention devices 385", 383", 348" prevent the backflow of any one of the fluids into any one of the other fluid lines. Controller 337" can be utilized to control operation of throttle devices 378", 348", 390" to coordinate the injections of the vapor refrigerant, cooling liquid, and liquid refrigerant.

Refrigeration system 320 uses a liquid-refrigerant injection system 372 to inject liquid refrigerant into an intermediate-pressure cavity of compressor 322 to reduce the discharge temperature of the refrigerant and the temperatures associated with the compression process. In conjunction with the cooling-liquid injection system 333, the compression process may approach or achieve isothermal compression. In conjunction with the economizer system 370, the capacity of the refrigerant to absorb heat in evaporator 364 can be increased and the cooling capacity of refrigeration system 320 can be increased. Liquid-refrigerant injection system 372 may be used, however, in a refrigeration system that does not include both the economizer system 370 and the cooling-liquid injection system 333.

Figure 7:
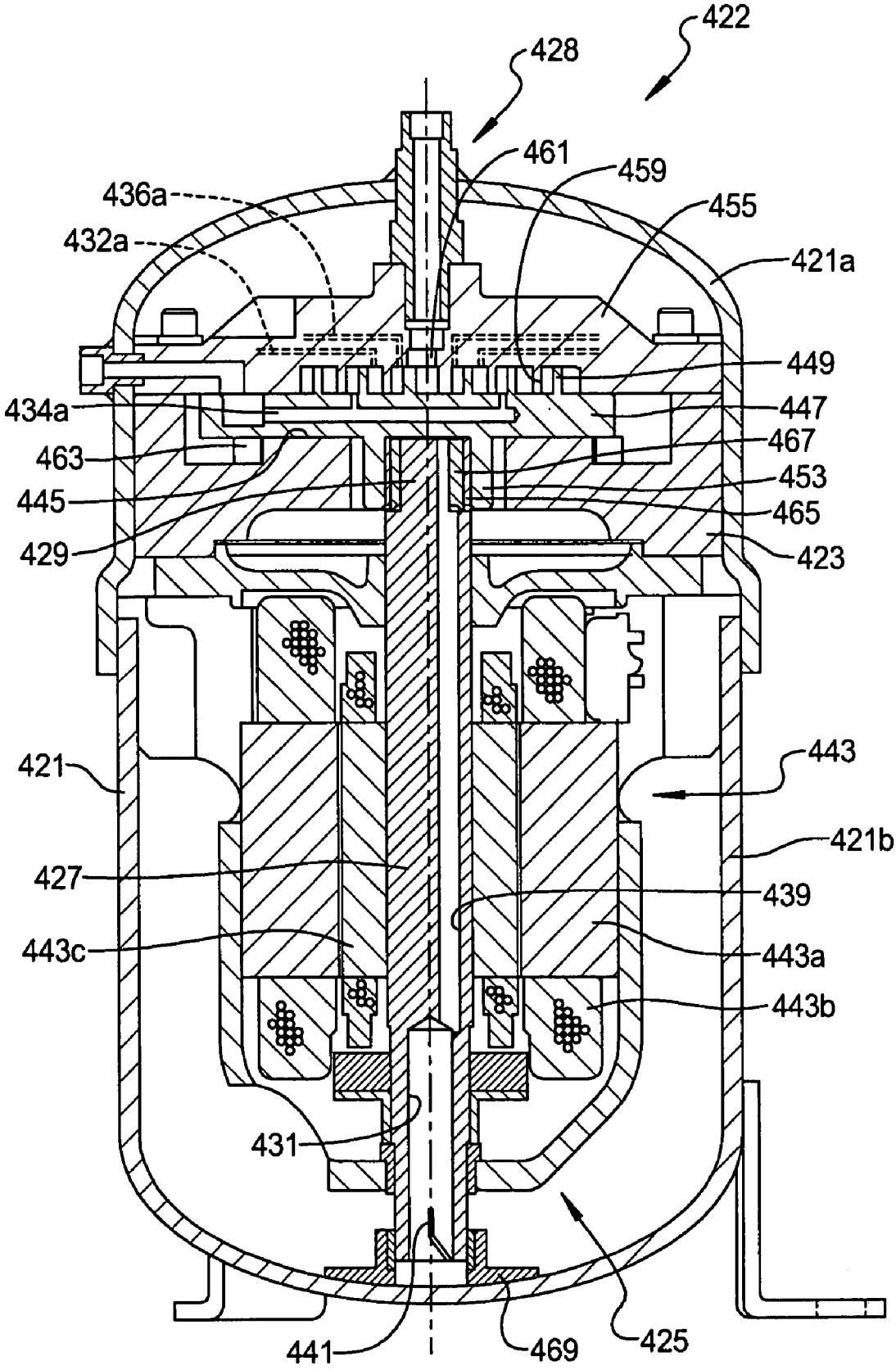
FIG. 7 is a cross-sectional view of a scroll compressor suitable for use in refrigeration systems according to the present teachings.
Figure 8:
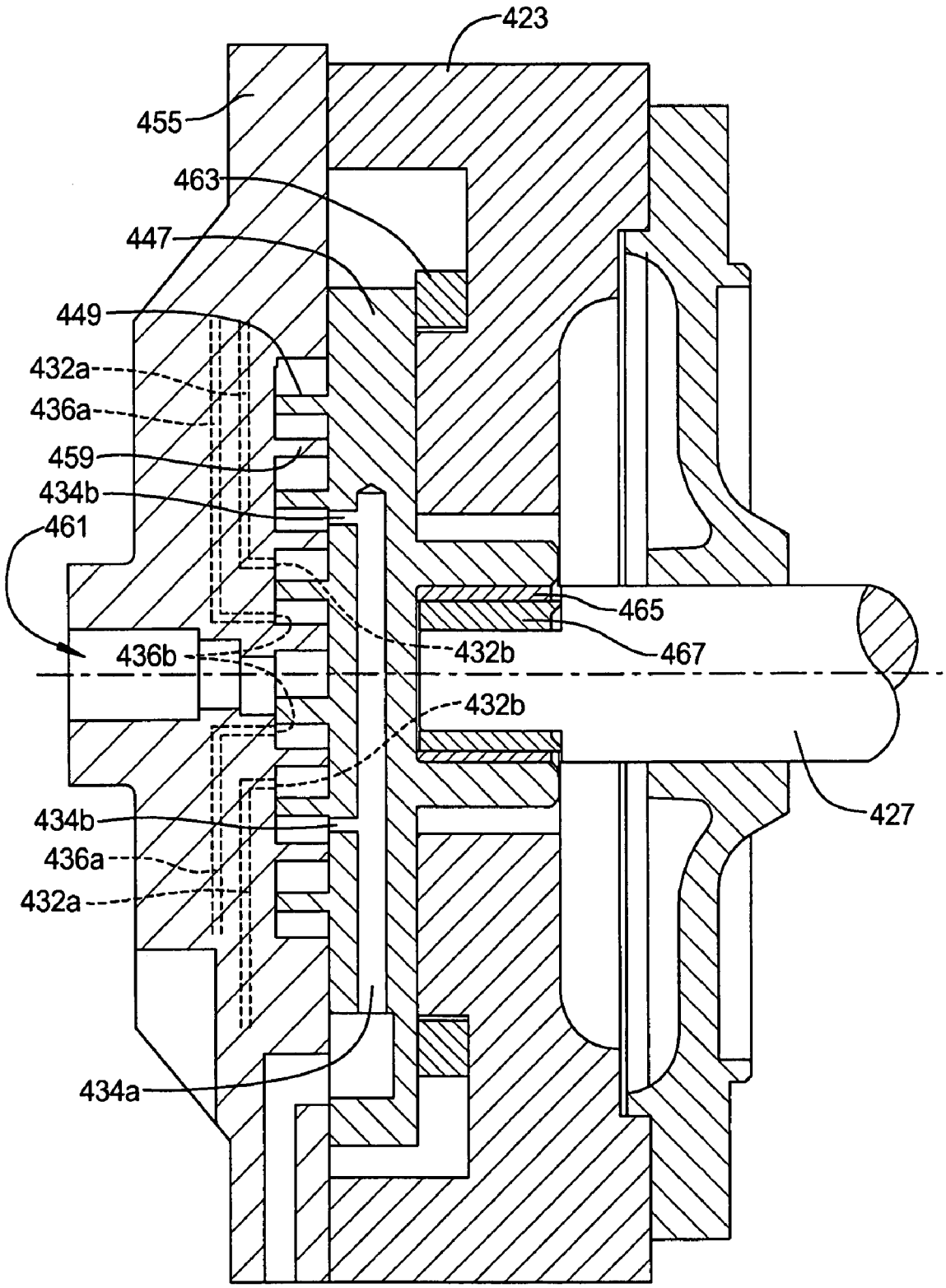
FIG. 8 is an enlarged fragmented cross-sectional view of a portion of the compressor of FIG. 7 showing the scroll members.
Figure 9:
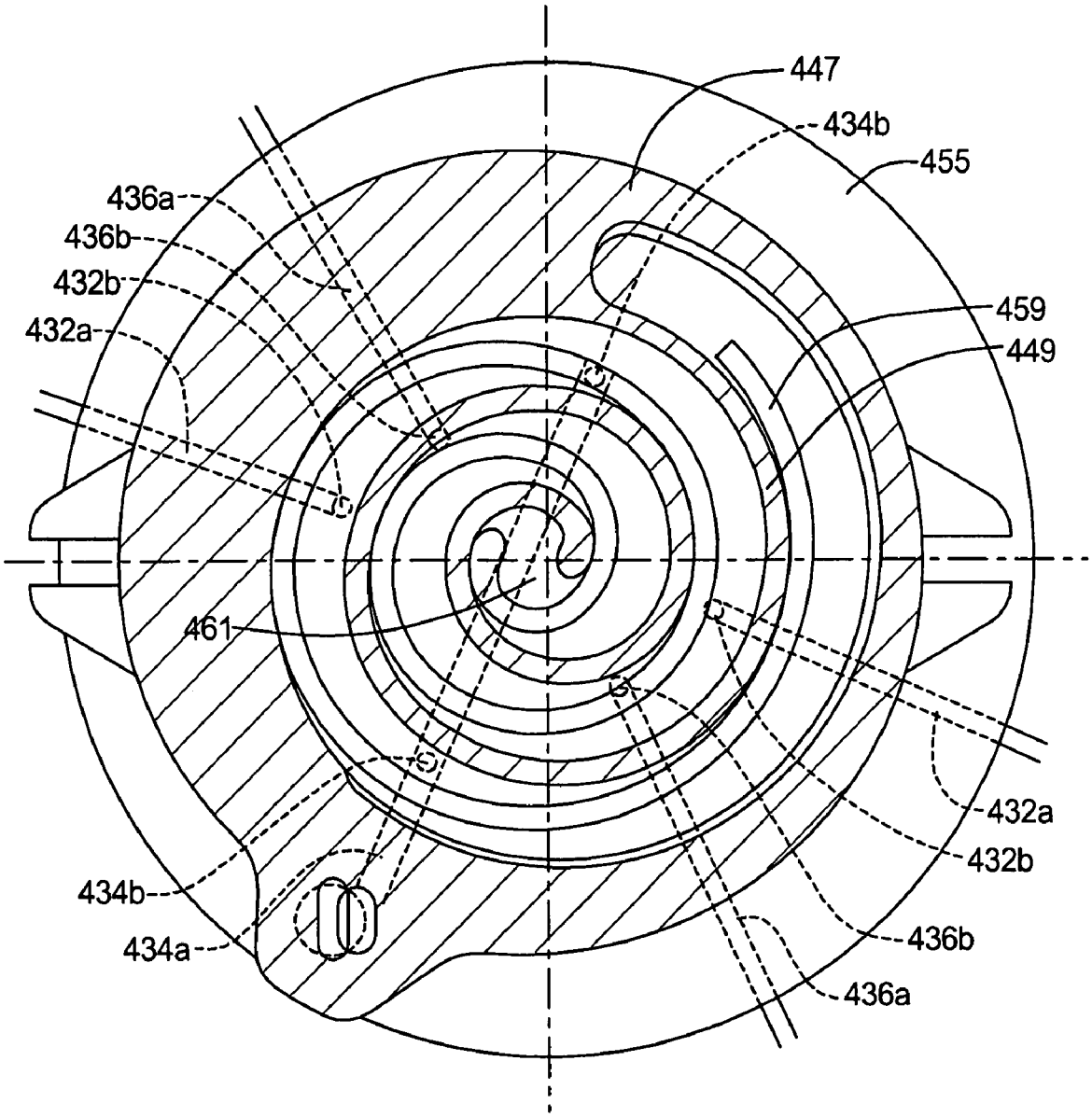
FIG. 9 is a top-plan view of fixed scroll member of the compressor of FIG. 7.

Referring now to FIGS. 7-9, a compressor 422 that can be used in refrigeration systems 20, 120, 220, 320 is shown. Compressor 422 is a scroll compressor and includes a shell 421 having upper and lower shell components 421*a*, 421*b* that are attached together in a sealed relationship. Upper shell 421*a* is provided with a refrigerant discharge port 428 which may have the usual discharge valve therein (not shown). A stationary main bearing housing or body 423 and a lower bearing assembly 425 are secured to shell 421. A driveshaft or crankshaft 427 having an eccentric crankpin 429 at the upper end thereof is rotatably journalled in main bearing housing 423 and in lower bearing assembly 425. Crankshaft 427 has at the lower end a relatively large diameter concentric bore 431 which communicates with a radially outwardly inclined smaller diameter bore 439 extending upwardly therefrom to the top of crankshaft 427. Disposed within bore 431 is a stirrer 441. The lower portion of lower shell 421*b* forms a sump which is filled with lubricant and bore 431 acts as a pump to pump lubricating fluid up crankshaft 427 and into bore 439 and ultimately to various portions of the compressor that require lubrication. A strainer 469 is attached to the lower portion of shell 421*b* and directs the oil flow into bore 431.

Crankshaft 427 is rotatably driven by an electric motor 443 disposed within lower bearing assembly 425. Electric motor 443 includes a stator 443*a*, windings 443*b* passing therethrough, and a rotor 443*c* rigidly mounted on crankshaft 427.

The upper surface of main bearing housing 423 includes a flat thrust-bearing surface 445 supporting an orbiting scroll 447, which includes a spiral vane or wrap 449 on an upper surface thereof. Projecting downwardly from the lower surface of orbiting scroll 447 is a cylindrical hub 453 having a journal bearing 465 and a drive bushing 467 therein and within which crankpin 429 is drivingly disposed. Crankpin 429 has a flat on one surface that drivingly engages a flat surface (not shown) formed in a portion of the drive bushing to provide a radially compliant drive arrangement, such as shown in assignee's U.S. Pat. No. 4,877,382, entitled "Scroll-Type Machine with Axially Compliant Mounting," the disclosure of which is herein incorporated by reference. An Oldham coupling 463 can be positioned between and keyed to orbiting scroll 447 and bearing housing 423 to prevent rotational movement or orbiting scroll 447. The Oldham coupling 463 may be of the type disclosed in the above-referenced U.S. Pat. No. 4,877,382; however, other Oldham couplings, such as the coupling disclosed in assignee's U.S. Pat. No. 6,231,324, entitled "Oldham Coupling for Scroll Machine," the disclosure of which is hereby incorporated by reference, may also be used.

A non-orbiting scroll 455 includes a spiral vane or wrap 459 positioned in meshing engagement with wrap 449 of orbiting scroll 447. Non-orbiting scroll 455 has a centrally disposed discharge passage 461 communicating with discharge port 428.

Wraps 449 of orbiting scroll 447 orbit relative to wraps 459 of non-orbiting scroll 455 to compress fluid therein from a suction pressure to a discharge. Non-orbiting scroll 455 includes a plurality of passageways that extend therethrough and open to intermediate-pressure cavities between wraps 449, 459. These passageways are extensions of the first and third intermediate-pressure ports 432, 436 and are used to supply cooling liquid and liquid refrigerant, respectively, to the intermediate-pressure cavities formed between wraps 449 of orbiting scroll 447 and wraps 459 of non-orbiting scroll 455. Specifically, non-orbiting scroll 455 includes a pair of third intermediate-pressure port passageways 436 that each have an outlet 436*b* that communicate with the intermediate-pressure cavities between wraps 449, 459 close to discharge passage 461. Similarly, non-orbiting scroll 455 includes a pair of first intermediate-pressure port passageways 432*a* that have outlets 432*b* that communicate with intermediate-pressure cavities between wraps 449, 459 at a lower intermediate-pressure location than outlets 436*b*. Orbiting scroll 447 also includes a second intermediate-pressure port passageway 434*a* that has a pair of outlets 436*b* that communicates with the compression cavities between wraps 449, 459 at an intermediate-pressure location that corresponds to a lower pressure than outlets 432*b*.

Thus, in compressor 422, the liquid refrigerant can be injected into the intermediate-pressure cavities at the location that corresponds to higher pressure than that of the vapor refrigerant and cooling liquid. The cooling liquid can be injected into the intermediate-pressure cavities at a location that corresponds to an intermediate pressure that is less than the pressure at the injection location of the liquid refrigerant but is greater than the pressure at the injection location for the vapor refrigerant.

It should be appreciated that while compressor 422 is shown as having a pair of passageways and a single passageway corresponding to the fluid flows to be injected into the intermediate-pressure cavities, that each fluid flow to be injected can have more or less than two passageways. Furthermore, it should also be appreciated that while compressor 422 is shown and configured for injecting three different fluid flows, compressor 422 could have more or less injection passageways to accommodate more or less distinct injection flow paths.

Figure 10:
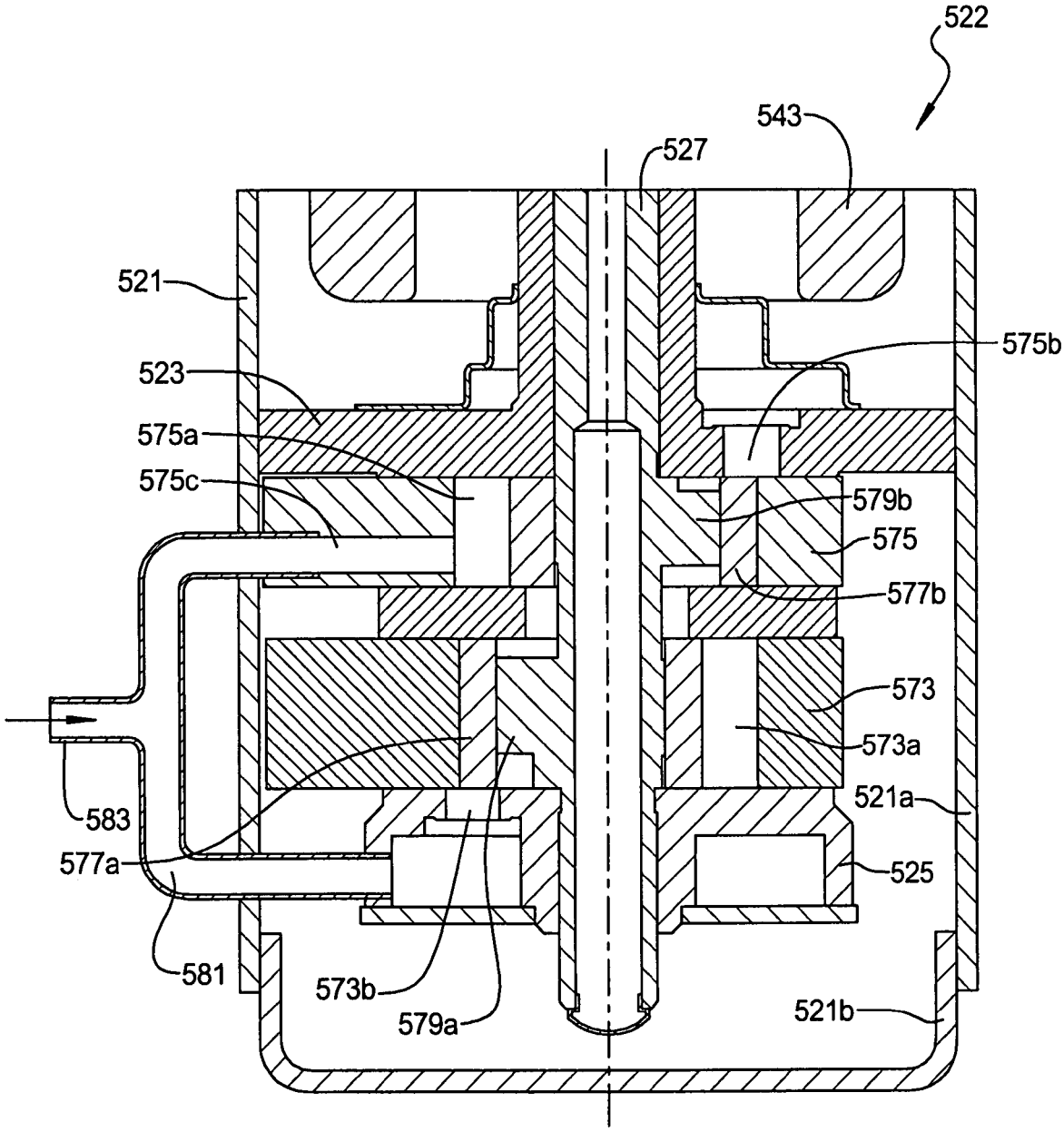
FIG. 10 is a fragmented cross-sectional view of a two-stage rotary compressor suitable for use in the refrigeration systems according to the present teachings.

Referring now to FIG. 10, a fragmented cross-section of a two-stage, two-cylinder rotary compressor 522 suitable for use in refrigeration systems 20, 120, 220, and 320 is shown. Compressor 522 includes a shell 521 having upper and lower portions 521*a*, 521*b* sealing fixed together. Upper and lower bearing assemblies 523, 525 are disposed in compressor 522. A crankshaft 527 is rotatably disposed in upper and lower bearing assemblies 523, 525. An electric motor 543 (only partially shown) is operable to rotate crankshaft 527. Crankshaft 527 extends through first and second stage compression cylinders 573, 575 each having a circular compression cavity 573*a*, 575*a* therein. First and second stage compression rollers 577*a*, 577*b* are disposed around crankshaft 527 within respective first and second compression cavities 573*a*, 575*a*. Crankshaft 527 includes first and second radially outwardly extending eccentrics 579*a*, 579*b* that can be about 180 degrees out of phase. Eccentrics 579*a*, 579*b* are respectively disposed in compression rollers 577*a*, 577*b*. Eccentrics 579*a*, 579*b* bias a portion of the respective compression rollers 577*a*, 577*b* toward the wall of the respective first and second compression cavities 573*a*, 575*a*. Rotation of crankshaft 527 thereby causes compression rollers 577*a*, 577*b* to move eccentrically within first and second compression cavities 573*a*, 575*a* to compress a fluid flowing therethrough.

First stage compression cylinder 573 is operable to compress a fluid therein from a suction pressure to an intermediate pressure. First stage compression cylinder 573 includes a discharge port 573*b* through which compressed fluid exits first stage compression cylinder 573. An intermediate-pressure flow path 581 communicates with discharge 573*b* and with an inlet port 575*c* of second stage compression cylinder 575. Second stage compression cylinder 575 is operable to compress a fluid therein from the intermediate pressure to a discharge pressure greater than the critical pressure. A discharge port 575*b* of second stage compression cylinder 575 allows the compressed fluid to be discharged from second stage compression cavity 575*a*. Thus, in compressor 522, a fluid can flow into first stage compression cylinder 573 and be compressed therein from a suction pressure to an intermediate pressure and routed into second stage compression cylinder 575. In second stage compression cylinder 575, the fluid is compressed from the intermediate pressure to the discharge pressure and discharged through discharge port 575*b*.

In compressor 522, the refrigerant vapor, cooling liquid, and/or liquid refrigerant can all be injected into intermediate-pressure flow path 581 for injection into the second stage compression cylinder 575 along with the fluid discharged from first stage compression cylinder 573. To facilitate this, an injection line 583 can communicate with intermediate-pressure flow path 581 to allow the vapor refrigerant, cooling liquid, and/or liquid refrigerant to be injected into flow path 581 which is an intermediate-pressure location. Thus, a two-stage rotary compressor 522 can be used to compress a refrigerant therein and can have vapor refrigerant, liquid refrigerant, and/or cooling liquid injected into an intermediate-pressure location of compressor 522.

Figure 11:
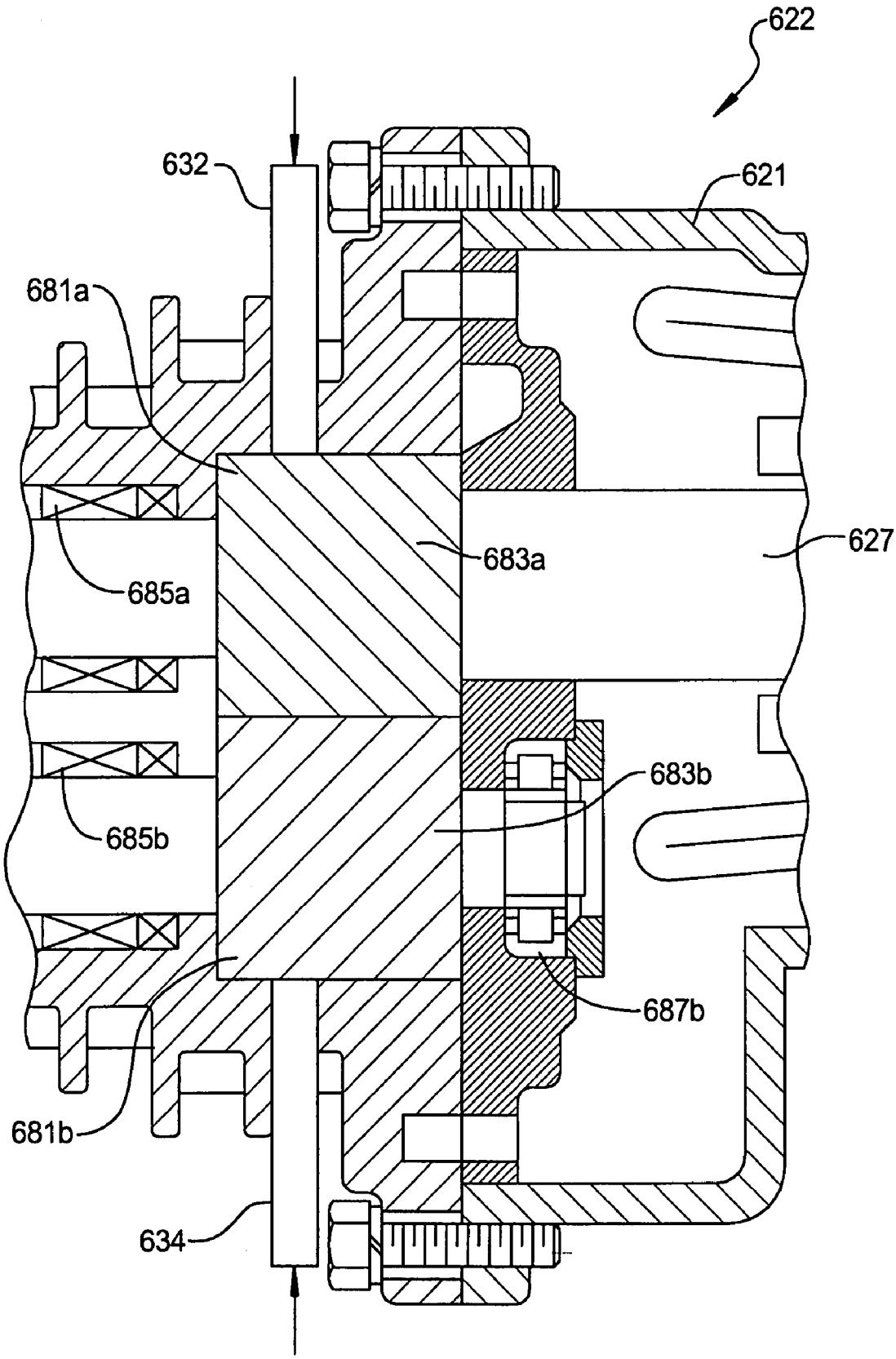
FIG. 11 is a fragmented cross-sectional view of a portion of a screw compressor suitable for use in the refrigeration systems according to the present teachings.

Referring now to FIG. 11, a fragmented cross-sectional view of another compressor 622 suitable for use in refrigeration systems 20, 120, 220, and 320 is shown. Compressor 622 is a screw compressor and includes a housing 621 within which a pair of rotating screws 681*a*, 681*b* is disposed. Screws 681*a*, 681*b* include intermeshing helical vanes 683*a*, 683*b* that engage with one another and compress a fluid flowing therebetween from a suction pressure to a discharge pressure. Male screw 681*a* is attached to a driveshaft 627 that extends therethrough and is supported at its front end by a front bearing assembly 685*a*. Driveshaft 627 can rotate screw 681*a* within compressor 622. The female screw 621*b* is coupled to a shaft having a front end rotatably supported in a front bearing assembly 685*b* and a rear bearing 687*b*. As screws 681*a*, 681*b* rotate in opposite directions, the fluid is drawn into the cavities formed by vanes 683*a*, 683*b*. The volume available between vanes 683*a*, 683*b* progressively degreases during rotation and compresses the fluid and pushes it toward the outlet. In this manner, screws 681*a*, 681*b* compress a refrigerant from a suction pressure to a discharge pressure.

Compressor 622 can include multiple intermediate-pressure injection ports, such as intermediate-pressure injection ports 632, 634 that communicate with intermediate-pressure cavities within vanes 683*a*, 683*b* of screws 681*a*, 681*b*. In this manner, cooling liquid and vapor refrigerant can be injected into intermediate-pressure cavities of compressor 622. It should be appreciated that a third intermediate-pressure port (not shown) to inject liquid refrigerant into the compression cavities at an intermediate-pressure location can also be employed. Thus, a screw compressor 622 can be utilized in refrigeration systems 20, 120, 220, 320 and can include multiple intermediate-pressure injection ports to allow fluids to be injected into compressor 622 at intermediate-pressure locations.

Referring now to FIG. 12, a schematic representation of another compressor 722 that can be utilized in refrigeration systems 20, 120, 220, and 320 is shown. Compressor 722 includes a housing 721 within which compression members 789 are disposed. In compressor 722, gas/liquid separator 738 is disposed within housing 721. Thus, compressor 722 includes an internal gas/liquid separator 738. Compression members 789 discharge the compressed fluid directly into separator 738. Within separator 738, the cooling liquid is separated from the gaseous refrigerant and removed therefrom through line 740. The gaseous refrigerant is routed from separator 738 through high-pressure line 756. Thus, a compressor 722 having an internal gas/liquid separator 738 can be utilized in refrigeration systems 20, 120, 220, and 320.

Referring now to FIG. 13, another compressor 822 suitable for use in refrigeration systems 20, 120, 220, and 320 is shown. Compressor 822 is similar to compressor 722 in that gas/liquid separator 838 is disposed within housing 821 along with compression members 889. In compressor 822, cooling-liquid system 833 is integral with compressor 822. Specifically, heat exchanger 842 is coupled to housing 821 by supports 891. Heat exchanger 842 allows heat $Q_{801}$ to be extracted from the cooling liquid flowing through cooling-liquid system 833.

Additionally, compressor 822 can also include an integral gas cooler 851. Gas cooler 851 can be attached to housing 821 by supports 893. Gas cooler 851 can remove heat $Q_{802}$ from the gaseous refrigerant flowing from separator 838. Thus, a compressor 822 having an integral cooling-liquid system 833 coupled thereto can be used in compression systems 20, 120, 220, and 320. Additionally, a compressor 822 having an integral gas cooler 851 can also be utilized in refrigeration systems 20, 120, 220, and 320.

The use of an integral cooling-liquid system 833 enables the compressor manufacturer to provide the compressor 822 and the cooling-liquid system 833 as a single unit, thereby facilitating the supplying of the appropriate controls and protections for compressor 822 by the compressor manufacturer.

In the refrigeration systems 20, 120, 220, 320, injection of the cooling liquid, liquid refrigerant and/or the refrigerant vapor may be cyclic, continuous or regulated. For example, when the compressor is a single-stage compressor, the intermediate-pressure ports can be cyclically opened and closed in conjunction with the operation of the compression members therein. In a scroll compressor, the port(s) can be cyclically opened and closed due to the wrap of one of the scroll members blocking and unblocking an opening in the other scroll member as a result of the relative movement. In a screw compressor, the vanes of the screws can cyclically block and unblock the openings to the pressure cavities therein as a result of the movement of the screws. Continuous injection may be provided to single-stage compressors by maintaining an opening into the compression cavities at an intermediate-pressure location open at all times. Additionally, the flow paths leading to the intermediate-pressure locations of the compression cavities may include valves operated in a manner that regulates the injection of the fluid.

In a two-stage compressor, such as a reciprocating piston or rotary compressor, the injection can be continuous, cyclical or regulated. In the two-stage compressors, the cooling-liquid injection, liquid-refrigerant injection and/or vapor injection can be directed to an intermediate-pressure chamber within which refrigerant discharged by the first stage is located prior to flowing into the second stage of the compressor. The flow paths to the intermediate-pressure chamber may be continuously open to allow a continuous injection of the fluid streams. Valves may be disposed in the flow paths to provide a cyclic or regulated injection of the fluid streams. The injection of the different fluids may all be continuous, cyclic, regulated, or any combination thereof.

While refrigeration systems 20, 120, 220, 320 may efficiently operate using a refrigerant in the trans-critical regime, it may also be used in the sub-critical regime.

The refrigeration systems according to the present teachings have been described with reference to specific examples and configurations. It should be appreciated that changes in these configurations can be employed without deviating from the spirit and scope of the present teachings. Such variations are not to be regarded as a departure from the spirit and scope of the claims.

What is claimed is:

1. A refrigeration system comprising:

a compressor having a suction port, a discharge port, and at least one passageway communicating with at least one intermediate-pressure location of said compressor and through which a fluid can be injected into said intermediate-pressure location, said compressor compressing a refrigerant and a cooling liquid flowing therethrough to a discharge pressure greater than a suction pressure, said cooling liquid is a single-phase lubricant that absorbs heat within said compressor caused by compression of said refrigerant and said cooling liquid;

a separator separating said refrigerant and said cooling liquid;

a first flow path communicating with said separator and said passageway and through which a first stream of refrigerant from said separator flows and is injected into said intermediate-pressure location of said compressor, said first stream being predominantly refrigerant vapor when injected into said intermediate-pressure location;

a second flow path communicating with said separator and said passageway and through which a second stream of refrigerant flows and is injected into said intermediate-pressure location of said compressor, said second stream being predominately liquid refrigerant when injected into said intermediate-pressure location; and a third flow path from said separator to said passageway and through which a third stream of predominantly cooling liquid from said separator flows and is injected into said intermediate-pressure location of said compressor.

2. The refrigeration system of claim 1, wherein said at least one passageway is at least two passageways, said at least one intermediate-pressure location is at least two intermediate-pressure locations, said first stream being injected into a first one of said intermediate-pressure locations through a first one of said passageways, and said second and third streams being injected into a second one of said intermediate-pressure locations through a second one of said passageways.

3. The refrigeration system of claim 2, further comprising:

a first throttle device in said first flow path reducing a pressure of said first stream to lower than said discharge pressure and greater than an intermediate pressure of said first intermediate-pressure location thereby injecting said first stream into said first intermediate-pressure location; and a second throttle device in said second flow path controlling the flow of said second stream thereby injecting said second stream in a predominantly liquid state into said second intermediate-pressure location and changing to a predominantly vapor state inside said compressor.

4. The refrigeration system of claim 3, wherein said first intermediate-pressure location has a first pressure, said second intermediate-pressure location has a second pressure, and said second pressure is greater than said first pressure.

5. The refrigeration system of claim 4, further comprising:

a fourth flow path extending from said separator to said suction port, said fourth flow path being a main refrigerant flow path and receiving a fourth stream of refrigerant from said separator, said first and second flow paths extending from said fourth flow path to said first and second passageways, respectively, and said first and second streams are minority portions of said fourth stream; and a heat exchanger through which said first and fourth flow paths extend in heat-transferring relation, said heat exchanger transferring heat from said fourth stream to said third stream.

6. The refrigeration system of claim 3, further comprising:

a heat exchanger in said third flow path removing heat from said third stream thereby reducing a temperature of said third stream and exhausting compression heat from the system; and a third throttle device in said third flow path between said heat exchanger and said third passageway reducing a pressure of said third stream to lower than said discharge pressure and greater than an intermediate pressure of said second intermediate-pressure location thereby injecting said third stream into said second intermediate-pressure location.

7. The refrigeration system of claim 6, wherein said third throttle device is responsive to a change in a discharge temperature of said compressor.

8. The refrigeration system of claim 7, wherein said second throttle device is responsive to a change in said discharge temperature of said compressor.

9. The refrigeration system of claim 8, wherein said second throttle device opens at a higher discharge temperature than said third throttle device.

10. The refrigeration system of claim 6, wherein said first, second and third streams are injected into different intermediate-pressure locations in said compressor.

11. The refrigeration system of claim 10, wherein said first intermediate-pressure location has a first pressure, said second intermediate-pressure location has a second pressure, said third intermediate-pressure location has a third pressure, said first pressure being less than said second and third pressures, and said second pressure being greater than said third pressure.

12. The refrigeration system of claim 3, further comprising:

a fourth flow path extending from said separator to said suction port, said third flow path being a main refrigerant flow path and receiving a fourth stream of refrigerant from said separator, said first and second flow paths extending from said fourth flow path to said first and second passageways, respectively;

a main throttle device disposed in said fourth flow path downstream of a location where said first and second flow paths extend from said fourth flow path, said main throttle device reducing a pressure of said fourth stream flowing therethrough;

an evaporator in said fourth flow path downstream of said main throttle device, said evaporator transferring heat into said fourth stream flowing therethrough; and a heat exchanger disposed in first and second sections of said fourth flow path with said first and second sections in heat-transferring relation with one another through said heat exchanger, said first section being upstream of said main throttle device, said second section being downstream of said evaporator and upstream of said suction port, and said heat exchanger transferring heat from said fourth stream flowing through said first section into said fourth stream flowing through said second section.

13. The refrigeration system of claim 12, further comprising a gas cooler cooling refrigerant flowing through said fourth flow path.

14. The refrigeration system of claim 12, wherein a flow rate of refrigerant in said first stream is equal to or greater than a flow rate of refrigerant in said fourth stream flowing into said suction port.

15. The refrigeration system of claim 3, wherein said second throttle device is responsive to changes in a discharge temperature of said compressor.

16. The refrigeration system of claim 15, further comprising a temperature sensing device responsive to a discharge temperature of said compressor and wherein said second throttle device regulates flow of said second stream therethrough based on an output of said temperature sensing device.

17. The refrigeration system of claim 3, wherein said second throttle device actively regulates flow of said second stream therethrough.

18. The refrigeration system of claim 1, wherein said compressor is a scroll compressor having at least two compression members intermeshed therein with compression cavities formed therebetween.

19. The refrigeration system of claim 18, wherein said intermediate-pressure location is a compression cavity formed between said compression members.

20. The refrigeration system of claim 1, wherein said compressor is a screw compressor having at least two compression members intermeshed therein with compression cavities formed therebetween.

21. The refrigeration system of claim 1, wherein said compressor is a two-stage compressor having a first stage operable to compress said refrigerant and lubricant from a suction pressure to an intermediate pressure and a second stage operable to compress said refrigerant and lubricant from said intermediate pressure to said discharge pressure.

22. The refrigeration system of claim 1, wherein said compressor is a single-stage compressor.

23. The refrigeration system according to claim 1, wherein a normal discharge pressure of said compressor is greater than a critical pressure of said refrigerant.

24. The refrigeration system according to claim 23, wherein said refrigerant is $CO_2$.

25. The refrigeration system of claim 1, wherein said first, second, and third streams are all injected into said compressor through the same passageway into the same intermediate-pressure location.

26. A refrigeration system comprising:

a compressor having a suction port, a discharge port, and at least one passageway communicating with at least one intermediate-pressure location of said compressor, said compressor compressing a refrigerant and a single-phase cooling liquid flowing therethrough to a discharge pressure greater than a suction pressure;

a separator separating said refrigerant and said cooling liquid;

a first flow path extending from said separator to said at least one passageway and through which a first stream of cooling liquid from said separator flows and is injected into said at least one intermediate-pressure location of said compressor, said cooling liquid absorbing heat within said compressor caused by said compression;

a second flow path communicating with said separator and said at least one passageway and through which a second stream of refrigerant flows and is injected into said at least one intermediate-pressure location of said compressor, said refrigerant in said second stream being predominately liquid refrigerant when injected into said at least one intermediate-pressure location; and a third flow path communicating with said separator and said at least one passageway and through which a third stream of refrigerant flows and is injected into said intermediate-pressure location of said compressor, said refrigerant in said third stream being predominately vapor refrigerant when injected into said intermediate-pressure location.

27. The refrigeration system of claim 26, wherein said at least one passageway is at least two passageways, said at least one intermediate-pressure location is at least two intermediate-pressure locations, said first stream being injected into a first one of said intermediate-pressure locations through a first one of said passageways and said second stream being injected into a second one of said intermediate-pressure locations through a second one of said passageways.

28. The refrigeration system of claim 27, wherein said first intermediate-pressure location has a first pressure, said second intermediate-pressure location has a second pressure, and said second pressure is greater than said first pressure.

29. The refrigeration system of claim 27, further comprising:

a first throttle device in said first flow path reducing a pressure of said first stream to lower than said discharge pressure and greater than an intermediate pressure of said first intermediate-pressure location thereby injecting said first stream into said first intermediate-pressure location; and a second throttle device in said second flow path controlling the flow of said second stream thereby injecting said second stream in a predominantly liquid state into said second intermediate-pressure location and changing to a predominantly vapor state inside said compressor.

30. The refrigeration system of claim 29, wherein at least one of said first and second throttle devices is responsive to a discharge temperature of said compressor.

31. The refrigeration system of claim 30, further comprising a temperature sensing device responsive to a discharge temperature of said compressor and wherein at least one of said first and second throttle devices regulates flow therethrough based on an output of said temperature sensing device.

32. The refrigeration system of claim 30, wherein both of said first and second throttle devices regulate flow therethrough based on said discharge temperature of said compressor.

33. The refrigeration system of claim 32, wherein said second throttle device opens to allow flow therethrough after said first throttle device opens to allow flow therethrough.

34. The refrigeration system of claim 32, wherein said second throttle device opens at a higher discharge temperature than said first throttle device.

35. The refrigeration system of claim 29, wherein said first throttle device regulates flow of said first stream therethrough to provide primary cooling of compression heat generated by said compressor and said second throttle device regulates flow of said second stream therethrough to supplement cooling of compression heat generated by said compressor.

36. The refrigeration system of claim 29, wherein said second throttle device reduces a pressure of said second stream thereby changing said second stream from a predominantly gaseous-refrigerant stream to a predominately liquid-refrigerant stream across said second throttle device.

37. The refrigeration system of claim 26, wherein said at least one passageway is at least three passageways, said at least one intermediate-pressure location is at least three intermediate-pressure locations, said first stream being injected into a first one of said intermediate-pressure locations through a first one of said passageways, said second stream being injected into a second one of said intermediate-pressure locations through a second one of said passageways, and said third stream being injected into a third one of said intermediate-pressure locations through a third one of said passageways.

38. The refrigeration system of claim 37, wherein said first intermediate-pressure location has a first pressure, said second intermediate-pressure location has a second pressure, said third intermediate-pressure location has a third pressure, said second pressure is greater than said first pressure, and said first pressure is greater than said third pressure.

39. The refrigeration system of claim 26, wherein a flow rate of refrigerant in said third stream injected into said compressor is equal to or greater than a flow of refrigerant flowing into said suction port of said compressor.

40. The refrigeration system of claim 26, wherein said compressor is a scroll compressor having at least two compression members intermeshed therein with compression cavities formed therebetween.

41. The refrigeration system of claim 40, wherein said intermediate-pressure location is a compression cavity formed between said compression members.

42. The refrigeration system of claim 26, wherein said compressor is a screw compressor having at least two compression members intermeshed therein with compression cavities formed therebetween.

43. The refrigeration system of claim 26, wherein said compressor is a two-stage compressor having a first stage operable to compress said refrigerant and cooling liquid from a suction pressure to an intermediate pressure and a second stage operable to compress said refrigerant and cooling liquid from said intermediate pressure to said discharge pressure.

44. The refrigeration system of claim 26, wherein said compressor is a single-stage compressor.

45. The refrigeration system according to claim 26, wherein a normal discharge pressure of said compressor is greater than a critical pressure of said refrigerant.

46. The refrigeration system of claim 45, wherein said refrigerant is $CO_2$.

47. The refrigeration system of claim 26, wherein said first, second, and third streams are all injected into said compressor through the same passageway into the same intermediate-pressure location.

48. The refrigeration system of claim 26, wherein said a least one passageway includes at least two passageways, said at least one intermediate-pressure location includes at least two intermediate-pressure locations, said first and second streams being injected into a first one of said intermediate-pressure locations through a first one of said passageways, and said third stream being injected into a second one of said intermediate-pressure locations through a second one of said passageways.

49. A refrigeration system comprising:

a compressor having a suction port, a discharge port, and at least one passageway communicating with at least one intermediate-pressure location of said compressor, said compressor compressing a refrigerant and a single-phase cooling liquid flowing therethrough to a discharge pressure greater than a suction pressure;

a separator separating said refrigerant and said cooling liquid;

a first flow path extending from said separator to said at least one passageway and through which a first stream of cooling liquid from said separator flows and is injected into said at least one intermediate-pressure location of said compressor, said cooling liquid absorbing heat within said compressor caused by said compression;

a second flow path communicating with said separator and said at least one passageway and through which a second stream of refrigerant flows and is injected into said at least one intermediate-pressure location of said compressor, said refrigerant in said second stream being predominately liquid refrigerant when injected into said at least one intermediate-pressure location:

a third flow path extending from said separator to said suction port, said third flow path being a main refrigerant flow path and receiving a third stream of refrigerant from said separator, said second flow path extending from said third flow path to at said least one passageway and said second stream is a minority portion of said third stream;

a pressure reducing device in said second flow path reducing a pressure of said second stream to lower than said discharge pressure and greater than an intermediate pressure of said at least one intermediate-pressure location thereby changing said second stream from a predominately vapor-refrigerant stream to a predominately liquid-refrigerant stream and injecting said second stream into said at least one intermediate-pressure location;

a main throttle device disposed in said third flow path downstream of a location where said second flow path extends from said third flow path, said main throttle device reducing a pressure of said third stream flowing therethrough;

an evaporator in said third flow path downstream of said main throttle device, said evaporator transferring heat into said third stream flowing therethrough; and a heat exchanger disposed in first and second sections of said third flow path with said first and second sections in heat-transferring relation with one another through said heat exchanger, said first section being upstream of said main throttle device, said second section being downstream of said evaporator and upstream of said suction port, and said heat exchanger transferring heat from said third stream flowing through said first section into said third stream flowing through said second section.

* * * * *